US006256903B1

(12) United States Patent
Rudd

(10) Patent No.: US 6,256,903 B1
(45) **Date of Patent: *Jul. 10, 2001**

(54) COATING DRYER SYSTEM

(75) Inventor: Paul D. Rudd, Minneapolis, MN (US)

(73) Assignee: Research, Incorporated, Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/265,711

(22) Filed: Mar. 9, 1999

Related U.S. Application Data

(63) Continuation of application No. 09/008,688, filed on Jan. 16, 1998, now Pat. No. 5,901,462, which is a continuation of application No. 08/697,407, filed on Aug. 23, 1996, now Pat. No. 5,713,138.

(51) Int. Cl.[7] ..... F26B 13/30

(52) U.S. Cl. ..... 34/412; 34/442; 34/528; 34/535; 34/219; 34/605; 34/202

(58) Field of Search ..... 34/528, 535, 540, 34/543, 546, 549, 580, 61, 71, 92, 123, 605, 621, 626, 637, 187, 186, 210, 219, 380, 381, 412, 442, 500, 202, 117, 118, 119, 120

(56) References Cited

U.S. PATENT DOCUMENTS

| | | | |
|---|---|---|---|
| 2,000,684 | 5/1935 | Allen et al. | 34/48 |
| 2,157,388 | 5/1939 | MacArthur | 101/416.1 |
| 2,565,570 | 8/1951 | Messinger | 219/19 |
| 2,578,633 | 12/1951 | Mauffre | 34/87 |
| 2,703,224 | 3/1955 | Robinson | 257/95 |
| 3,159,464 | 12/1964 | Early et al. | 34/4 |
| 3,629,555 | 12/1971 | Herbert, Jr. | 219/525 |
| 3,667,132 | 6/1972 | Herbert, Jr. | 34/18 |
| 3,935,646 * | 2/1976 | Grandine et al. | 34/92 |
| 4,124,875 | 11/1978 | Van Zantwyk | 361/227 |

FOREIGN PATENT DOCUMENTS

| | | | |
|---|---|---|---|
| 613 960 | 2/1961 | (CA) | 101/424.1 |
| 213-855 | 8/1986 | (EP) | 101/424.1 |
| 2 073 390 | 10/1981 | (GB) | 101/424.1 |
| 2 142 874 | 1/1985 | (GB) | 101/424.1 |

OTHER PUBLICATIONS

"Applying High Density Infrared Heat", Research Inc., 1994, 20 pp.

COMCO FlexoPack™ brochure, 2 pp. (published prior to Aug. 23, 1996).

"Heat and Mass Transfer Between Impinging Gas Jets and Solid Surfaces", *Journal Advances In Heat Transfer* 13, 1977, pp. 1–60.

(List continued on next page.)

*Primary Examiner*—Stephen Gravini
(74) *Attorney, Agent, or Firm*—Kinney & Lange, P.A.

(57) ABSTRACT

The present invention relates to heating systems for drying wet coatings such as printing inks, paint, sealants, etc. applied to a substrate. In particular, the invention relates to a drying system in which a blower having an inlet directs a current of heated gas such as air towards a wet coating on a substrate to dry the coating and wherein the heated air is circulated back to the inlet of the blower once the air impinges the coating on the substrate. The present invention also relates to a drying system in which the substrate is supported about a thermally conductive roll having a plurality of energy emitters disposed within the conductive roll along a length of the conductive roll. The plurality of energy emitters are controlled to selectively emit energy along the length of the conductive roll. The dryer system preferably includes means for sensing temperatures of the roll along the length of the conductive roll, wherein the energy emitted by the energy emitters along the length of the roll varies based upon the sensed temperatures along the length of the roll.

23 Claims, 14 Drawing Sheets

U.S. PATENT DOCUMENTS

| | | | | |
|---|---|---|---|---|
| 4,132,011 | | 1/1979 | Nichols | 34/86 |
| 4,169,321 | | 10/1979 | Nichols | 34/23 |
| 4,402,267 | | 9/1983 | DeMoore | 101/419 |
| 4,474,552 | | 10/1984 | Smith | 431/328 |
| 4,501,072 | | 2/1985 | Jacobi, Jr. et al. | 34/1 |
| 4,698,767 | | 10/1987 | Wensel et al. | 364/471 |
| 4,716,658 | | 1/1988 | Jacobi, Jr. | 34/4 |
| 4,724,764 | | 2/1988 | MacPhee et al. | 101/451 |
| 4,727,655 | | 3/1988 | Jacobi, Jr. | 34/4 |
| 4,767,042 | | 8/1988 | Daane | 226/97 |
| 4,768,695 | | 9/1988 | Stibbe | 226/97 |
| 4,773,167 | | 9/1988 | Jacobi, Jr. | 34/4 |
| 4,785,986 | | 11/1988 | Daane et al. | 226/97 |
| 4,787,547 | | 11/1988 | Hella et al. | 226/97 |
| 4,833,794 | | 5/1989 | Stibbe et al. | 34/156 |
| 4,882,992 | | 11/1989 | Schmoeger | 101/424.1 |
| 4,922,628 | | 5/1990 | Hella | 34/156 |
| 4,938,404 | | 7/1990 | Helms et al. | 226/10 |
| 4,944,098 | | 7/1990 | Hella et al. | 34/156 |
| 4,967,656 | | 11/1990 | Douglas et al. | 101/142 |
| 4,972,774 | | 11/1990 | MacPhee | 101/450.1 |
| 4,977,828 | | 12/1990 | Douglas | 101/142 |
| 5,060,572 | | 10/1991 | Waizmann | 101/424.1 |
| 5,094,010 | | 3/1992 | Jacobi et al. | 34/1 R |
| 5,105,562 | | 4/1992 | Hella et al. | 34/156 |
| 5,121,560 | | 6/1992 | Daane et al. | 34/13 |
| 5,134,788 | | 8/1992 | Stibbe et al. | 34/44 |
| 5,147,690 | | 9/1992 | Faust et al. | 34/156 X |
| 5,154,092 | | 10/1992 | MacPhee | 74/425 |
| 5,177,878 | * | 1/1993 | Visser | 34/92 |
| 5,209,179 | | 5/1993 | Herbert et al. | 118/46 |
| 5,242,095 | | 9/1993 | Creapo et al. | 226/97 |
| 5,272,971 | | 12/1993 | Fredricks | 101/136 |
| 5,303,484 | * | 4/1994 | Hagen et al. | 34/656 |
| 5,309,838 | | 5/1994 | Kurz | 101/480 |
| 5,321,595 | | 6/1994 | Jacobi et al. | 362/373 |
| 5,379,697 | | 1/1995 | Ertl | 101/424.1 |
| 5,416,979 | * | 5/1995 | Joiner | 34/120 X |
| 5,452,524 | | 9/1995 | Isozaki et al. | 34/546 X |
| 5,465,504 | * | 11/1995 | Joiner | 34/446 |
| 5,483,984 | * | 1/1996 | Donlan, Jr. et al. | 134/122 R |
| 5,515,619 | * | 5/1996 | Kahl et al. | 34/117 X |
| 5,546,675 | * | 8/1996 | McGraw et al. | 34/117 |
| 5,553,391 | | 9/1996 | Bakalar | 34/273 X |
| 5,565,040 | * | 10/1996 | Donlan, Jr. et al. | 134/26 |
| 5,617,647 | * | 4/1997 | Okane et al. | 34/218 |
| 5,634,402 | * | 6/1997 | Rudd et al. | 101/424.1 |
| 5,722,180 | * | 3/1998 | Joiner | 34/115 |
| 5,737,848 | * | 4/1998 | Chau-Huu et al. | 34/115 X |
| 5,937,538 | * | 8/1999 | Joiner | 34/115 X |
| 5,953,832 | * | 9/1999 | Rosynsky et al. | 34/303 |
| 5,953,833 | * | 9/1999 | Rudd | 34/528 |

OTHER PUBLICATIONS

Speed–Dri™, Inck Drying System, Model 4560, A System Using Infrared Heat and Air for Drying Ink Jet Prin Research Inc., pp. 2–5.

"AMJO Infra–Red and Ultra–Violet Curing Systems Web Fed Presses," Amjo, Inc., 3 pp. (published prior to 8/.

"Apply High Density Infrared Heat," Research Inc. brochure, No. 5000–B–01–C, 1996, 18 pp.

"Hot Air Systems," Clenro, Inc. internet information, Thomas Publishing Company, 4 pp. (published prior to.

* cited by examiner

CONTROLLER
31
17
18
20
10
32
22
30
35
34
25
24
38
33
28
26
14
12
16

430
372
337
396C
12
322
342
382
416
426
335
412
428
420
408
332
425
412
426
416
396C
372
430

COATING DRYER SYSTEM

CROSS-REFERENCE TO RELATED APPLICATION(S)

This application is a continuing application of application Ser. No. 08/697,407, filed Aug. 23, 1996, U.S. Pat. No. 5,713,138 and Ser. No. 09/008,688 filed Jan. 16, 1998, U.S. Pat. No. 5,901,462.

BACKGROUND OF THE INVENTION

The present invention relates to heating systems for drying wet coatings such as printing inks, paint, sealants, etc. applied to a substrate. In particular, the invention relates to a drying system in which a blower having an inlet directs a current of heated gas such as air towards a wet coating on a substrate to dry the coating and wherein the heated air is circulated back to the inlet of the blower once the air impinges the coating on the substrate. The present invention also relates to a drying system in which the substrate is supported about a thermally conductive roll having a plurality of energy emitters disposed within the conductive roll along a length of the conductive roll. The plurality of energy emitters are controlled to selectively emit energy along the length of the conductive roll. The dryer system preferably includes means for sensing temperatures of the roll along the length of the conductive roll, wherein the energy emitted by the energy emitters along the length of the roll varies based upon the sensed temperatures along the length of the roll.

Coatings, such as printing inks, are commonly applied to substrates such as paper, foil or polymers. Because the coatings often are applied in a liquid form to the substrate, the coatings must be dried while on the substrate. Drying the liquid coatings is typically performed by either liquid vaporization or radiation-induced polymerization depending upon the characteristics of the coating applied to the substrate.

Water or solvent based coatings are typically dried using liquid vaporization. Drying the wet water-based or solvent-based coatings on the substrate requires converting the base of the coating, either a water or a solvent, into a vapor and removing the vapor latent air from the area adjacent the substrate. For the base within the coatings to be converted to a vapor state, the coatings must absorb energy. The rate at which the state change occurs and hence the speed at which the coating is dried upon the substrate depends on the pressure and rate at which energy can be absorbed by the coating. Because it is generally impractical to increase drying speeds by decreasing pressure, increasing the drying speed requires increasing the rate at which energy is absorbed by the coating.

Liquid vaporization dryers typically use convection, radiation, conduction or a combination of the three to apply energy to the coating and the substrate to dry the coating on the substrate. With convection heating, a gas, such as relatively dry air, is heated to a desired temperature and blown onto the coating and the substrate. The amount of heat transferred to the substrate and coating is dependent upon both the velocity and the angle of the air being blown onto the substrate and the temperature difference between the air and the substrate. At a higher velocity and a more perpendicular angle of attack, the air blown onto the substrate will transfer a greater amount of heat to the substrate. Moreover, the amount of heat transferred to the substrate will also increase as the temperature difference between the air and the substrate increases. However, once the substrate obtains a temperature equal to that of the temperature of the air, heat transfer terminates. In other words, the substrate will not get hotter than the air. Thus, the temperature of the air being heated can be limited to a level that is safe for the substrate.

Although controllable, convection heating is thermally inefficient. Because air, as well as nitrogen, have very low heat capacities, high volumes of air are required to transfer heat. Moreover, because the heated air blown onto the coating and substrate is typically allowed to escape once the heated air impinges upon the coating and the substrate, conventional drying systems employing convection heating typically use extremely large amounts of energy to continuously heat a large volume of outside ambient air to an elevated temperature in order to provide the high volumes of flow required for heat transfer. Because convention heating requires extremely large amounts of energy, drying costs are high.

Radiation heating occurs when two objects at different temperatures in sight are in view of one another. In contrast to convection heating, radiation heating transfers heat by electromagnetic waves. Radiation heating is typically performed by directing infrared rays at the coating and substrate. The infrared radiation is typically produced by enclosing electrical resistors within a tube of transparent quartz or translucent silica and bringing the electrical resistors to a red heat to emit a radiation of wavelengths from 10,000 to 30,000 angstrom units. The tubes typically extend along an entire width of the substrate.

The last method of applying energy to a coating and a substrate is through the use of conduction. Conductive heating of the coating and substrate is typically achieved by advancing a continuous substrate web about a thermally conductive roll or drum. Hot oil or steam is injected into the drum to heat the drum. As a result, the heated drum conducts heat to the substrate in contact with the drum. Because the drum must be configured so as to contain the hot oil or high pressure steam, the drum or roll is extremely complex and expensive to manufacture. In addition, because of the large mass of the drum required to accommodate the oil or high pressure steam, the dryer system employing the drum often requires a complex drive mechanism for rotating the heavy drums or rolls. This complex drive mechanism also increases the cost of the drying system. Moreover, because the oil or hot steam uniformly heats the thermally conductive drum across its entire length, the thermally conductive drum uniformly conducts energy or heat along the entire width of the substrate in contact with the drum regardless of varying drying requirements along the width of the substrate due to varying substrate and coating characteristics along the width of the substrate. As a result, portions of the substrate which do not contain wet coatings or which contain coatings that have already been dried unnecessarily receive excessive heat energy which is wasted. Conversely, other portions of the substrate containing large amounts of wet coatings may receive an insufficient amount of heat energy, resulting in extremely long drying times or offsetting of the wet coatings onto surface which come in contact with the wet coatings.

BRIEF SUMMARY OF THE INVENTION

The present invention is an improved dryer system for drying coatings applied to a substrate. In one preferred embodiment of the present invention, the dryer system includes a substrate support supporting the substrate, means for impinging the substrate with heated air, wherein the means for impinging has an inlet, and means for creating a partial vacuum adjacent the substrate to withdraw the heated air away from the substrate once the heated air has impinged the substrate. Preferably, the heated air withdrawn away from the substrate is circulated to the inlet once the heated air has impinged the substrate. In the preferred embodiment, the means for impinging preferably includes a pressure chamber adjacent the substrate, means for heating air within the pressure chamber and means for pressurizing air within the pressure chamber. The pressure chamber defines the inlet of the means for impinging and includes at least one outlet directed at the substrate. The means for circulating the heated air of the dryer system preferably includes a vacuum chamber in communication with the inlet of the means for impinging. The vacuum chamber has at least one inlet adjacent the substrate. Preferably, the pressure chamber includes a plurality of outlets and the vacuum chamber includes a plurality of inlets interspersed among and between the plurality of outlets. In the most preferred embodiments, the substrate support comprises a roll, wherein the means for impinging includes a plurality of outlets arcuately surrounding at least a portion of the roll and wherein the means for circulating includes a plurality of inlets arcuately surrounding at least a portion of the roll.

In another preferred embodiment of the dryer system, the dryer system includes a thermally conductive roll having a length and a peripheral surface for supporting the substrate. The dryer system also includes a plurality of energy emitters disposed within the conductive roll along the length of the conductive roll for emitting energy. The plurality of energy emitters are controlled to selectively emit energy along the length of the conductive roll. Preferably, the dryer system includes a plurality of temperature sensors along the length of the conductive roll. The energy emitted by the energy emitters along the length of the conductive roll is varied based upon sensed temperatures from the temperature sensors. In a most preferred embodiment of the dryer system, the energy emitters comprise band heaters.

In one preferred embodiment, the inventive dryer system is adapted for drying a coating applied to an advancing web. The dryer system includes a thermally conductive roll having an axial length and a circumferential outer surface for supporting the web. The housing extends about at least a portion of the roll, and the housing has an arcuate panel member radially spaced from the circumferential outer surface of the roll that extends along the length of the roll. The arcuate panel member has a plurality of alternating rows of coaxially extending inlet slots and recessed outlet troughs therein. A blower and plenum chamber assembly is disposed in the housing between the inlet slots and the outlet troughs, and is in communication with the slots and troughs to substantially recirculate air that has been forced toward the cylindrical outer surface through the inlet slots and that has been drawn away from the cylindrical outer surface through the outlet troughs. An axially extending radiant energy heating element and a radiant energy reflective member are both removably mounted within selected outlet troughs, and the reflective member is aligned to reflect radiant energy emitted from its respective heating element toward the cylindrical outer surface.

In another preferred embodiment of the dryer system for drying a coating applied to an advancing web, the dryer system is convertible between a first dryer and a second dryer. In either event, the dryer system includes a thermally conductive roll having an axial length and a circumferential outer surface for supporting the web. A housing extends about at least a portion of the roll with the housing having an arcuate panel member radially spaced from the circumferential outer surface and extending along the length of the roll. The arcuate panel member has a plurality of alternating rows of coaxially extending inlet slots and recessed outlet troughs therein. A blower and plenum chamber assembly is disposed in the housing between the inlet slots and the outlet troughs, and is in communication with the slots and troughs to substantially recirculate air that has been forced toward the cylindrical outer surface through the inlet slots and that has been drawn away from the cylindrical outer surface through the outlet troughs. By exchanging components in the outlet trough, the dryer system is convertible between its first dryer configuration and its second dryer configuration. The first dryer has an axially extending radiant heating element and a radiant energy reflective member movably mounted within selected outlet troughs. The reflective member is aligned to reflect radiant energy emitted from its respective heating element toward the cylindrical outer surface, and has an aperture therein to permit the flow of air therethrough. The second dryer has a trough cover panel removably mounted over selected outlet troughs. Each cover panel has a plurality of openings therein to permit the flow of air therethrough and into the outlet trough, with the openings being sized and spaced to minimize the presence of an air flow gradient across each outlet trough. An air heater is provided for selectively preheating the air before it flows through the inlet slots.

BRIEF DESCRIPTION OF THE DRAWINGS

The present invention will be further explained with reference to the drawing figures listed below, wherein like structure is referred to by like numerals throughout the several views.

While the above-identified drawing figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention. It should be specifically noted that the figures have not been drawn to scale, as it has been necessary to enlarge certain portions for clarity.

DETAILED DESCRIPTION OF THE PREFERRED EMBODIMENTS

Figure 1:
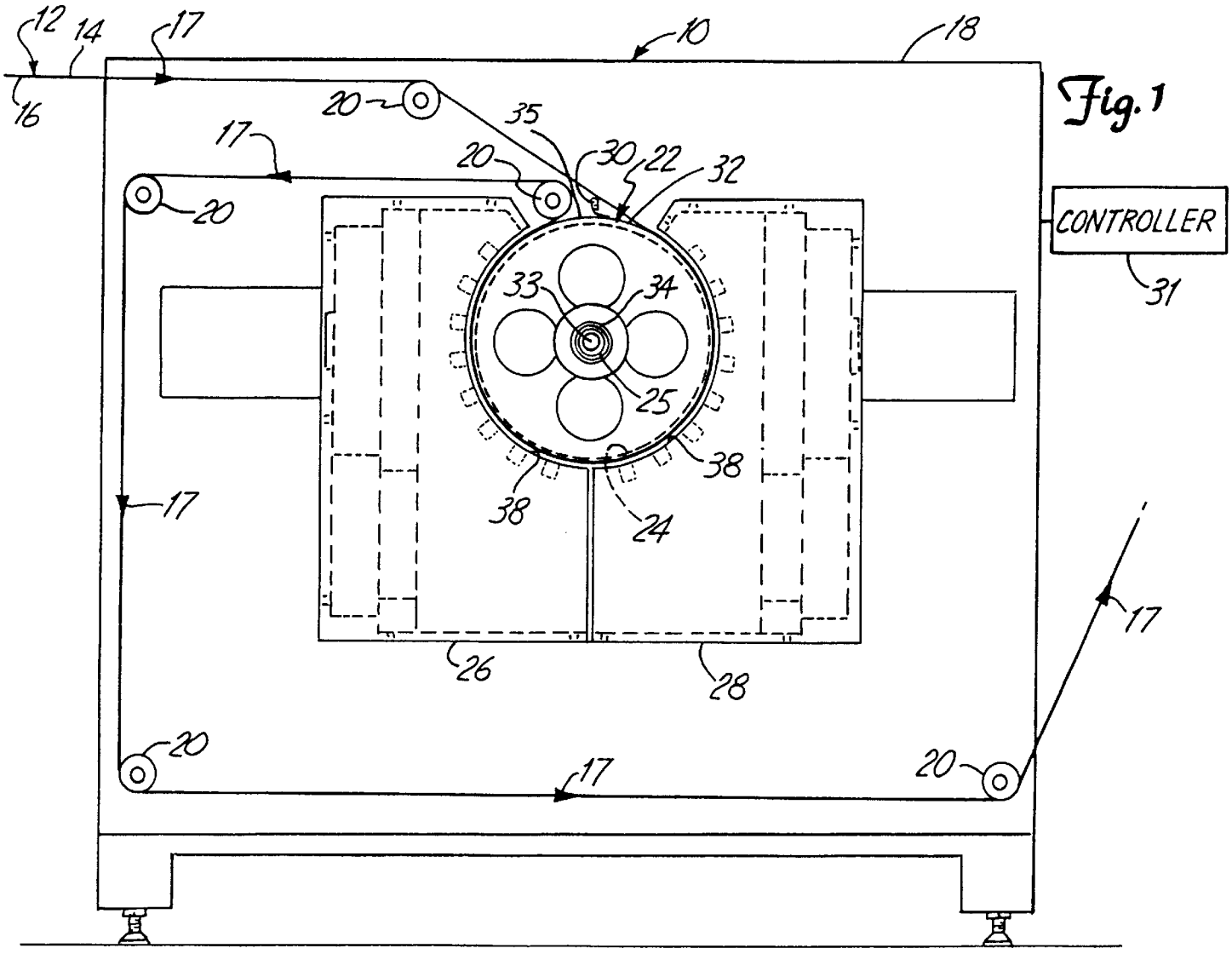
FIG. 1 is a side elevational view of a coating dryer system including a pair of convection units adjacent a substrate support.

FIG. 1 is a side elevational view of a coating dryer system 10 for drying a coating applied to substrate 12 having a front surface 14 and back surface 16. Arrow heads 17 on substrate 12 indicate the direction in which substrate 12, preferably a continuous web, is moved within coating dryer system 10. System 10 generally includes enclosure 18, positioning rolls 20, substrate support 22, energy emitters 24, slip ring assembly 25, convection units 26, 28, temperature sensors 30 and controller 31. Enclosure 18 is preferably made from stainless steel and houses and encloses dryer system 10.

Positioning rolls 20 are rotatably coupled to enclosure 18 in locations so as to engage back surface 16 of substrate 12 to stretch and position substrate 12 about substrate support 22. Positioning rolls 20 preferably support substrate 12 so as to wrap substrate 12 greater than approximately 290 degrees about substrate support 22 for longer dwell times and more compact dryer size. In addition, positioning rolls 20 guide and direct movement of substrate 12 through heater system 10.

Substrate support 22 engages back surface 16 of substrate 12 and supports substrate 12 between and adjacent to convection units 26, 28. Substrate support 22 preferably includes roll 32, axle 33 and bearings 34. Roll 32 preferably comprises an elongate cylindrical drum or roll having an outer peripheral surface 35 in contact with back surface 16 of substrate 12. Roll 32 is preferably formed from a material having a high degree of thermal conductivity such as metal. In the preferred embodiment, roll 32 is made from aluminum and has a thickness of about ⅜ of a inch. Preferably, surface 35 of roll 32 contacts the entire back surface 16 of substrate 12. Because roll 32 is formed from a material having a high degree of thermal conductivity, roll 32 conducts excess heat away from areas on the front surface 14 of substrate 12 which do not carry wet coating such as inks. As a result, the areas of substrate 12 that do not contain a wet coating do not burn from being over heated by heater 36. At the same time, because roll 32 is also in contact with areas on the front surface 14 of substrate 12 containing wet coatings such as inks, roll 32 conducts the excess heat back into the portions of substrate 12 containing wet coatings so that the coatings dry in less time. Axle 33 and bearings 34 rotatably support roll 32 with respect to enclosure 18 between convection units 26 and 28. Although substrate support 22 preferably comprises a thermally conductive roll rotatably supported between convection units 26 and 28, substrate support 22 may alternatively comprise any one of a variety of stationary or movable supporting structures having different configurations and made of different materials for supporting substrate 12 adjacent to convection units 26 and 28.

Energy emitters 24 are positioned within roll 32 and are configured and oriented so as to emit energy towards surface 35 for drying coatings applied to substrate 12. Slip ring assembly 25 transmits power to energy emitters 24 while energy emitters 24 rotate about axle 33 within roll 32. Slip ring assembly 25 preferably comprises a conventional slip ring assembly as supplied by Litton Poly-Scientific, Slip Ring Products, 1213 North Main Street, Blacksburg, Va. 24060.

In the preferred embodiment illustrated, emitters 24 are supported along the inner circumferential surface of roll 32. Because roll 32 is thermally conductive, the energy emitted by energy emitters 24 is conducted through roll 32 to back surface 16 of substrate 12. This energy is absorbed by substrate 12 to dry the coatings applied to substrate 12. Because energy emitters 24 are located within substrate support 22, energy emitters 24 are shielded from hot air emitted by convection units 26 and 28. As a result, energy emitters 24 are not directly exposed to the hot air which could otherwise damage energy emitters 24 depending upon the type of energy emitters utilized.

Convection units 26 and 28 are substantially identical to one another and are positioned adjacent substrate 12 opposite roll 32 of substrate support 22. In the preferred embodiment illustrated, convection units 26 and 28 each include an arcuate surface 38 extending substantially along the length of roll 32 and configured so as to arcuately surround substrate 12 and roll 32 in close proximity with substrate 12. Together, convection units 26 and 28 arcuately surround approximately 290 degrees of roll 32. As a result, energy emitters 24 and convection units 26, 28 apply energy to substrate 12 for a greater period of time, allowing dryer system 10 to be more compact.

Convection units 26 and 28 apply energy in the form of a heated gas to substrate 12. In particular, each convection unit 26, 28 impinges substrate 12 with heated dry air to dry the coating applied to substrate 12. After the heated dry air has impinged upon substrate 12, each convection unit 26, 28 recycles the heated air by repressurizing the air and reheating the air, if necessary, to the preselected desired temperature before once again impinging substrate 12 with the recycled heated air. To recycle the heated air once the heated air impinges upon substrate 12, each convection unit 26, 28 circulates the heated air to an inlet of the means for impinging substrate 12 with heated air. Although dryer system is shown as including two convection units 26, 28 arcuately surrounding and positioned adjacent to substrate support 22 and substrate 12, dryer system 10 may alternatively include a single convection unit or greater than two convection units adjacent to substrate support 22.

Temperature sensors 30 are supported by enclosure 18 adjacent to and in contact with roll 32. Temperature sensors 30 sense the temperature of substrate support 22, and, in particular, roll 32. Alternatively, sensors 30 may be positioned to sense temperatures of substrate 12.

Controller 31 comprises a conventional control unit that includes both power controls and process controls. Controller 31 is preferably mounted to enclosure 18 and is electrically coupled to temperature sensors 30, energy emitters 24 and convection units 26 and 28. Controller 31 uses the sensed temperatures of roll 32 sensed by temperature sensors 30 to control energy emitters 24 and convection units 26, 28 to vary the energy applied to substrate 12. As a result, dryer system 10 provides closed-loop feed back control of the energy applied to substrate 12.

Figure 2:
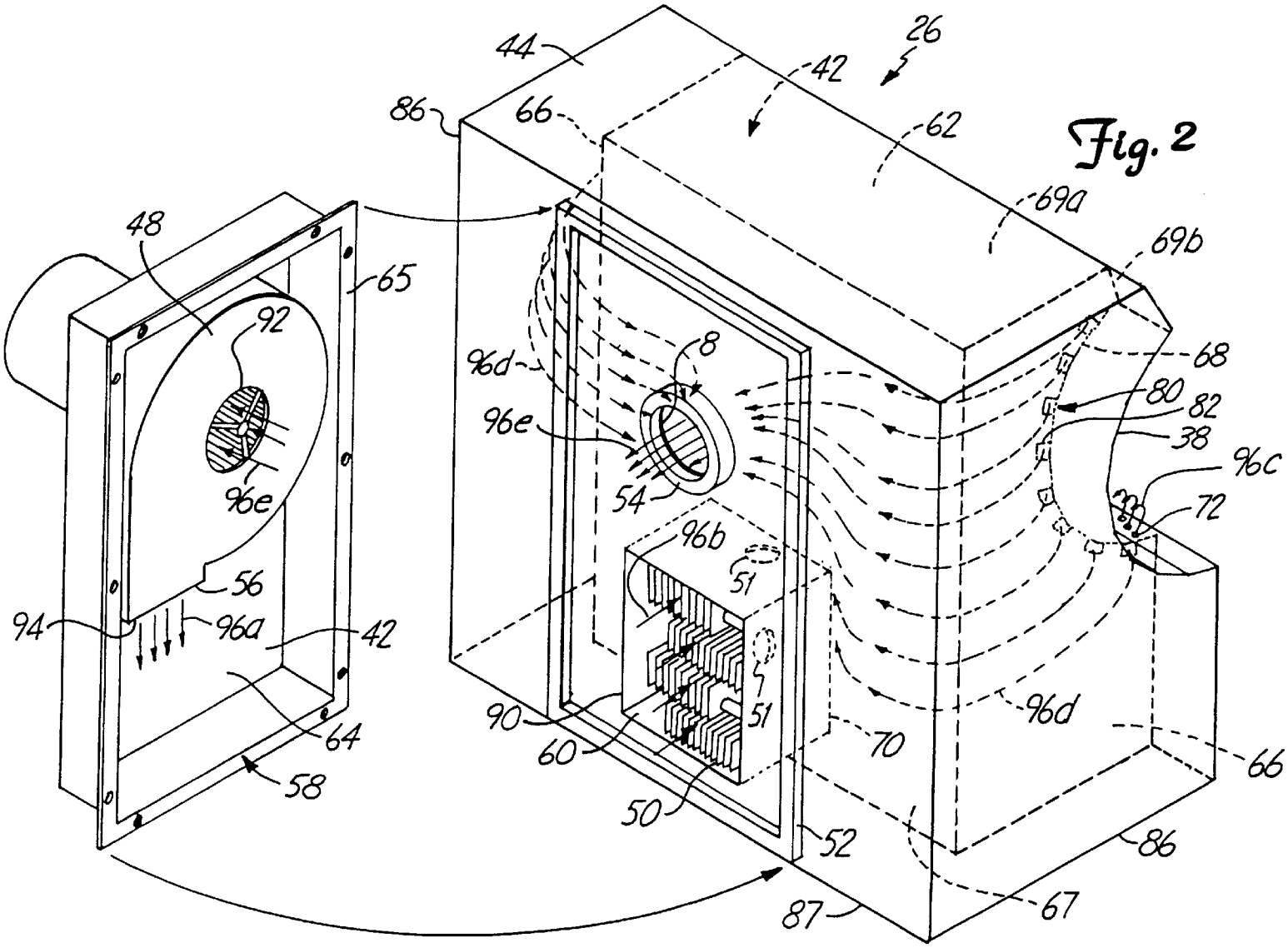
FIG. 2 is a perspective view of a convection unit taken from a rear of the convection unit with portions exploded away.

FIG. 2 is a perspective view of a preferred convection unit 26 taken from a rear of convection unit 26, with portions exploded away for illustration purposes. As best shown by FIG. 2, the exemplary embodiment of convection unit 26 generally includes pressure chamber 42, vacuum chamber 44, blower 48, heater 50, temperature sensors 51 and seals 52, 54. Pressure chamber 42 is an elongate fluid or air flow passage through which pressurized air flows until impinging substrate 12 (shown in FIG. 1). Pressure chamber 42 includes inlet 56, blower housing 58, duct 60 and plenum 62. Inlet 56 of pressure chamber 42 is generally the location in which pressurized air enters pressure chamber 42. In the preferred embodiment illustrated, inlet 56 comprises an outlet of blower 48. Alternatively, inlet 56 may comprise any fluid passage in communication between pressure chamber 42 and whatever conventionally known means or mechanisms are used for pressurizing air within pressure chamber 42.

Blower housing 58 is a generally rectangular shaped enclosure defining blower cavity 64 and forming flange 65. Flange 65 extends along an outer periphery of blower housing 58 and fixedly mounts against seal 52 to seal blower cavity 64 about duct 60. As a result, blower cavity 64 completely encloses and surrounds the outlet of blower 48 to channel and direct pressurized air from blower 48 through duct 60.

Duct 60 is a conduit extending between blower cavity 64 and an interior of plenum 62. Duct 60 provides an air tight passageway for pressurized air to flow from blower cavity 64 past vacuum chamber 44 into plenum 62.

Plenum 62 is a generally sealed compartment formed from a plurality of walls including sidewalls 66, rear wall 67, interface wall 68 and top walls 69*a*, 69*b*. The compartment forming plenum 62 is configured for containing the pressurized air and directing the pressurized air at substrate 12 along substrate support 22 (shown in FIG. 1). In particular, interface wall 68 extends opposite rear wall 67 and preferably defines the arcuate surface 38 adjacent to roll 32 (shown in FIG. 1). Rear wall 67 defines an inlet 70 while interface wall 68 defines a plurality of outlets 72. Inlet 70 is an opening extending through rear wall 67 sized for mating with duct 60 for permitting pressurized air from duct 60 to enter into plenum 62. Outlets 72 are apertures along arcuate surface 38 that extend through interface wall 68 to communicate with an interior of plenum 62. Outlets 72 are preferably located and oriented so as to permit pressurized air within plenum 62 to escape through outlets 72 and to impinge upon substrate 12 before being recycled or recirculate by vacuum chamber 44.

Vacuum chamber 44 is an elongate fluid or air flow passage extending from substrate 12 adjacent roll 32 of substrate support 22 (shown in FIG. 1) to blower 48. Vacuum chamber 44 includes inlets 80, channels 82 and outlet 84. Inlets 80 are preferably interspersed among and between outlets 72 of pressure chamber 42 across the entire surface 38 adjacent substrate 12 and substrate support 22 for uniform withdrawal of air across the surface of the substrate. Inlets 80 extend along surface 38 between surface 38 and channels 82. Channels 82 preferably comprise elongate troughs extending along surface 38 and recessed from inlets 80 to provide communication between vacuum chamber 44 and inlets 80. Outlet 84 of vacuum chamber 44 communicates between vacuum chamber 44 and an inlet of blower 48. As a result, blower 48 withdraws air from vacuum chamber 44 through outlet 84 to create the partial vacuum which draws heated air away from substrate 12 and substrate support 22 through inlets 80 once the heated air has impinged upon substrate 12.

In the preferred embodiment illustrated, vacuum chamber 44 includes side walls 86 and rear wall 87. Side walls 86 are spaced from side walls 66 of plenum 62 while rear wall 87 is spaced from rear wall 67 of plenum 62 to define the fluid or air flow passage comprising vacuum chamber 44. As a result of this preferred construction in which vacuum chamber 44 partially encloses plenum 62, side walls 66 and rear wall 67 of plenum 62 form a boundary of both plenum 62 and vacuum chamber 44 by serving as outer walls of plenum 62 and inner walls of vacuum chamber 44. Consequently, convection unit 26 is more compact and less expensive to manufacture.

As further shown by FIG. 2, rear wall 87 of vacuum chamber 44 supports seals 52 and 54 and defines outlet 84 and opening 90. Seal 52 is fixedly secured to an outer surface of rear wall 87 so as to encircle duct 60 and outlet 84 in alignment with flange 65 of blower housing 58. Seal 52 preferably comprises a foam gasket which is compressed between flange 65 and rear wall 87 to seal between blower housing 58 and duct 60.

Seal 54 is fixedly coupled to an exterior surface of rear wall 87 about outlet 84 of vacuum chamber 44. Seal 54 is also positioned so as to encircle an inlet of blower 48. Seal 54 seals between outlet 84 of vacuum chamber 44 and the inlet of blower 48. Seal 54 preferably comprises a foam gasket.

Opening 90 extends through wall 87 and is sized for receiving duct 60. Duct 60 extends between opening 90 within rear wall 87 and opening 70 within rear wall 67 of plenum 62. Duct 60 is preferably sealed to both rear walls 67 and 87 by welding. Alternatively, duct 60 may be sealed adjacent to both rear wall 67 and 87 by gaskets or other conventional sealing mechanisms so as to separate the vacuum created between rear walls 67 and 87 of vacuum chamber 44 and the high pressure air flowing through duct 60.

Blower 48 pressurizes air within pressure chamber 42 and creates the partial vacuum within vacuum chamber 44. Blower 48 generally comprises a conventionally known blower having an inlet 92 and an outlet 94. Blower 48 is preferably mounted within and partially through blower housing 58 so as to align inlet 92 with outlet 84 of vacuum chamber 44 surrounded by seal 54. As a result, blower 48 draws air from vacuum chamber 44 through outlet 84 of vacuum chamber 44 and through inlet 92 to create the partial vacuum within vacuum chamber 44. Blower 48 expels air through outlet 94 to pressurize the air within pressure chamber 42. Outlet 94 of blower 48 also serves as the inlet 56 of pressure chamber 42.

Overall, blower 48 drives the current or flow of air by pressurizing air within pressure chamber 42 and by withdrawing air from vacuum chamber 44. As indicated by arrows 96*a*, air is discharged from blower 48 out opening 94 into blower cavity 64 to pressurize air within blower cavity 64. The pressurized air flows from blower cavity 64 through duct 60 into plenum 62 as indicated by arrows 96*b*. Once within plenum 62, the pressurized air escapes through outlets 72 to impinge upon substrate 12 to assist in drying coatings upon substrate 12 as indicated by arrows 96*c*. Once the air has impinged upon substrate 12 (shown in FIG. 1), the vacuum pressure within vacuum chamber 44 draws the heated air into vacuum chamber 44 from substrate 12 through inlets 80. As indicated by arrows 96*d*, the vacuum pressure created at inlet 92 of blower 48 continues to draw the air through channels 82 and between side walls 66 and 86 and rear walls 67 and 87 until the heated air reaches outlet 84. Finally, as indicated by arrows 96*e,* the vacuum pressure created at inlet 92 of blower 48 sucks the air through outlet 84 of vacuum chamber 44 into inlet 92 of blower 48 where the air is once again recirculate.

Heater 50 heats recirculating air within convection unit 26. As shown by FIG. 2, heater 50 preferably heats air within pressure chamber 42 just prior to the air entering plenum 62. Preferably, heater 50 is positioned and supported within duct 60 so that the air flowing through duct 60 (as indicated by arrows 96*b*) flows through and across heaters 50 to elevate the temperature of the air flowing through duct 60. Heater 50 reaches temperatures of approximately 1200° F. (649° C.) to effectively transfer heat to the air passing through duct 60. Heater 50, preferably comprises a fin heater such as those supplied by Watlow of St. Louis, Mo. under the trademark FINBAR. Although heater 50 is illustrated as constituting fin heaters mounted within duct 60 of convection unit 26, heater 50 may comprise any one of a variety well known conventional heating mechanisms and structures for transferring heat and energy to air. Furthermore, heater 50 may alternatively be located so as to transfer heat to air within either pressure chamber 42 or vacuum chamber 44. In addition, heater 50 may also alternatively comprise multiple heating units positioned throughout convection unit 26. For example, heater 50 may alternatively include a fin heater positioned within duct 60 and a rod heater, such as those supplied by Watlow of St. Louis, Mo. under the trademark WATTROD, mounted within plenum 62.

Temperature sensors 51 preferably comprise thermocouples mounted within duct 60 between heater 50 and plenum 62. Temperature sensors 51 sense temperature of the air entering plenum 62. The temperatures sensed by temperature sensors 51 are used by controller 31 (shown in FIG. 1) to regulate heater 50. In particular, the amount of heat transferred to air flowing through duct 60 may be regulated by adjusting the temperature of heater 50 or by adjusting blower 48 to adjust the pressure of the air contained within pressure chamber 42 and flowing through duct 60. As can be appreciated, temperature sensors 51 may alternatively be located in a large variety of alternative locations within convection unit 26, including within plenum 62.

Figure 3:
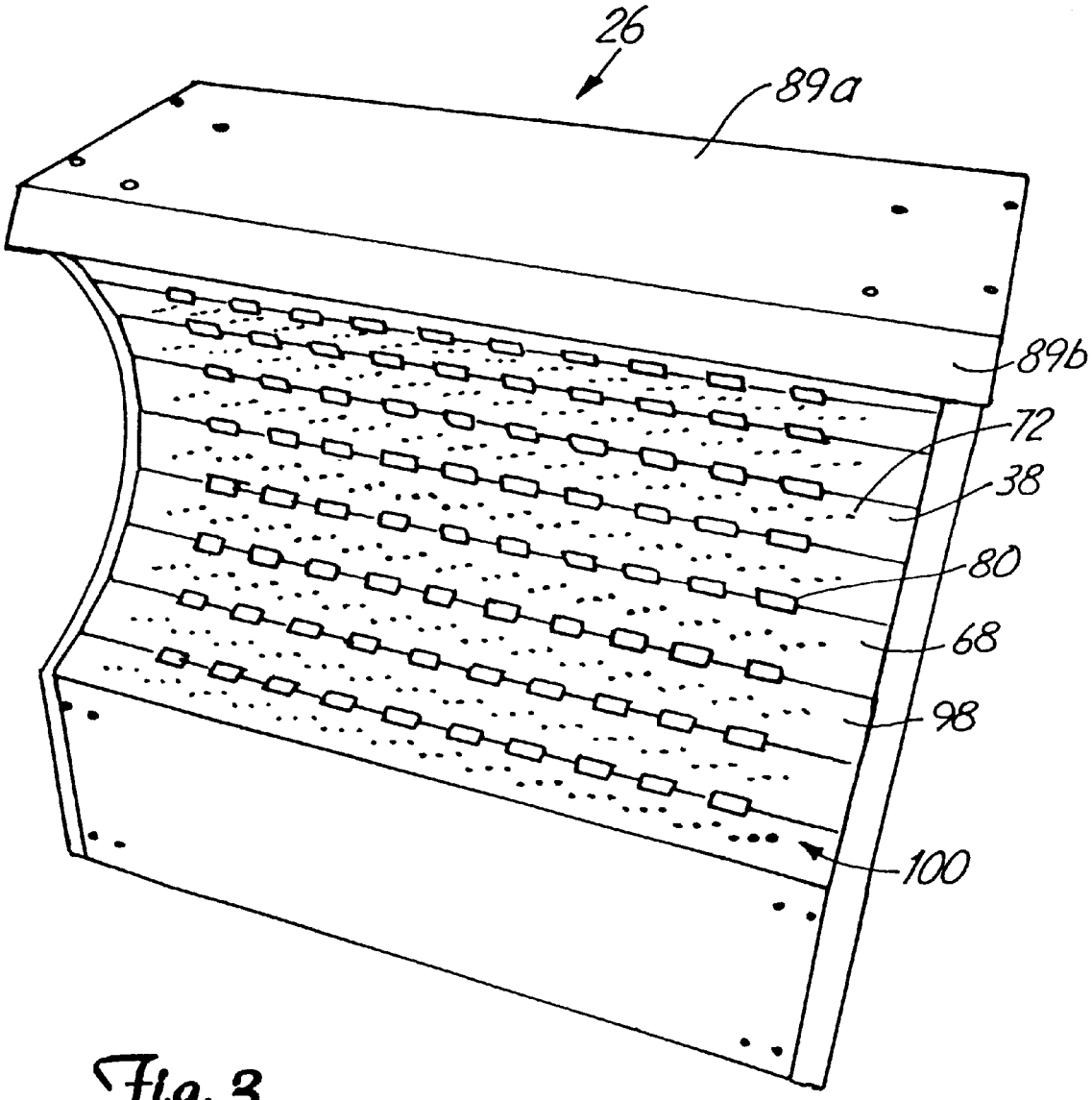
FIG. 3 is a perspective view of a front side of the convention unit.

FIG. 3 is a perspective view taken from a front side of convection unit 26 illustrating surface 38, outlets 72 and inlets 80 in greater detail. As best shown by FIG. 3, arcuate surface 38 of wall has nine facets 98 which are slightly angled with respect to one another to provide arcuate surface 38 with its arcuate cross-sectional shape. Each facet 98 includes a plurality of outlets 72 along its length. Outlets 72 are preferably uniformly dispersed along the length of each facet 98 and among the facets 98 to establish an inlet array 100 that provides uniform air flow to substrate 12 (shown in FIG. 1). Inlet array 100 is preferably configured to optimize heat and mass transfer with convection flow. The particular size and distribution of outlets 72 along surface 38 is based upon optimum heat and mass transfer studies and calculations found in Holger Martin, "Heat and Mass Transfer Between Impinging Gas Jets and Solid Surfaces," *Advances in Heat Transfer Journal,* Vol. 13, 1977, pp. 1–60 (herein incorporated by reference). In particular, assuming a turbulent air flow having a Reynolds value of greater than or equal to approximately 2,000, the size of outlets 72 is based upon the equation:

$$S=1/5H$$

where S is a diameter of the orifice constituting outlet 72 and H is the distance between outlet 72 and the surface of the substrate. Assuming an optimal orifice size, the spacing between outlets 72 is generally based upon the equation:

$$L=7/5H$$

where L is the spacing between the outlets 72 and H is the distance between outlet 72 and the substrate surface. As set forth in the optimizing equations, the size of each outlets 72 as well as the number of outlets 72 is dependent upon the distance between surface 38 and substrate 12 supported by substrate support 22 (shown in FIG. 1). The optimal spacial arrangement of outlet 72 (i.e. the combination of geometric variables that yields the highest average transfer coefficient for a given blower rating per unit area of transfer surface) is dependent upon three geometric variables for uniformly spaced arrays of outlets 72: the size of outlets 72, outlet-to-outlet spacing and the distance between surface 38 and substrate 12. The configuration of inlet array 100 is also dependent upon the static pressure created by blower 48.

In the preferred embodiment illustrated, surface 38 is approximately 450 square inches in surface area and is uniformly spaced from surface 35 of roll 32 (shown in FIG. 1) by approximately one inch. Blower 48 preferably creates approximately four inches water static pressure within plenum 62. Due to minimal losses of air from convection unit 26, blower 48 also creates approximately the same amount of vacuum within vacuum chamber 44. Surface 38 includes approximately 378 outlets 72 which are dispersed in a generally hexagonal array pattern across surface 38 at a ratio of about 1.20 outlets 72 per square inch. Each of outlets 72 is preferably a circular orifice having a diameter of about 0.25 inches. To lower the velocity of the heated air exiting outlets 72, the diameter of outlet 72 was increased from the calculated optimum of 0.2 inches to the preferred diameter of approximately 0.25 inches. As a result of the enlarged diameter of outlets 72, the spacing between outlets 72 (0.5 inches) is less than the optimal spacing (1.4 inches) to ensure adequate surface area for inlets 80. Although outlets 72 are preferably circular in shape, outlets 72 may alternatively have a variety of different shapes including slots. Furthermore, outlets 72 may also comprise circular or slotted nozzles for directing heated air or other heated gas at the substrate. In the preferred embodiment of convection unit 26, heated air flows through each outlet 72 so as to strike the substrate with a velocity of approximately 25 miles per hour (36 feet per second). The air flowing through outlet 72 preferably has a maximum velocity of 30 miles per hour to prevent unintended movement of the coating across the surface of substrate 12. As can be appreciated, the maximum velocity of air flow is dependent upon the particular substrate and the particular coating applied to the substrate.

Inlets 80 generally comprise openings uniformly spaced along surface 38 in communication with channels 82 behind surface 38 (shown in FIG. 2). Inlets 80 communicate between surface 38 and vacuum chamber 44 so that the partial vacuum created by blower 48 in vacuum chamber 44 draws heated air into vacuum chamber 44 through inlets 80 once the heated air has initially impinged upon the substrate. As shown by FIG. 3, inlets 80 extend along surface 38 between facets 98. Inlets 80 are preferably sized as large as possible while maintaining the structural integrity of arcuate wall 68 and while also providing an adequate number of appropriately sized outlets 72 along surface 38. Because inlets 80 are preferably sized as large as possible, inlets 80 permit the vacuum created by blower 48 within vacuum chamber 44 to withdraw a larger volume of heated air from along the substrate into vacuum chamber 44 to minimize losses of heated air from convection unit 26. At the same time, by forming inlets 80 as large as possible, the suction through inlets 80 is reduced to insure that the heated pressurized air passing through outlets 72 impinges upon the substrate before being withdrawn into vacuum chamber 44 through inlets 80.

In the preferred embodiment illustrated, surface 38 includes eighty inlets across the 450 square inch surface 38. Each inlet 80 is a one by one square inch opening or orifice. As a result, surface 38 has approximately 80 square inches of vacuum inlets. Surface 38 also has approximately 18.55 square inches of pressurized outlets 72. The ratio of inlet area to outlet area across surface 38 (i.e., the ratio of pressure to vacuum orifice area) is approximately 0.23. In other words, for every square inch opening in communication between substrate 12 and pressure chamber 42, surface 38 has approximately 4.34 square inches of openings communicating between substrate 12 and vacuum chamber 44. It has been discovered that this ratio of pressure chamber outlet opening to vacuum chamber inlet opening enables convection unit 26 to sufficiently impinge substrate 12 with heated air while adequately withdrawing heated air from substrate 12 to minimize the loss of heated air from convection unit 26 and to also improve drying efficiency by minimizing air pressure stagnation along substrate 12.

Figure 4:
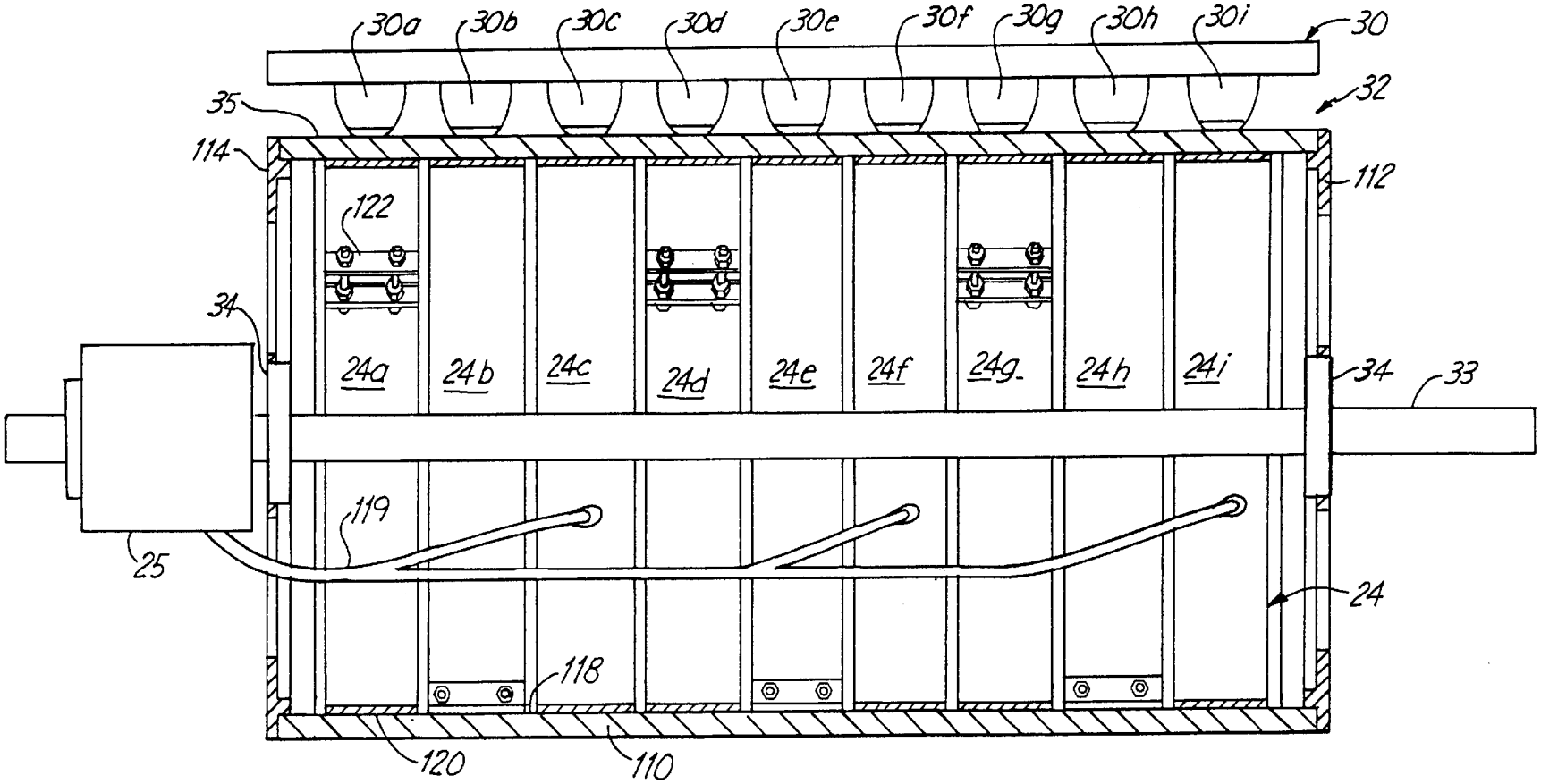
FIG. 4 is an enlarged sectional view of the substrate support.

FIG. 4 is a sectional view of roll 32 and energy emitters 24 with temperature sensors 30. As best shown by FIG. 4, roll 32 is an elongate cylindrically shaped hollow drum having an exterior wall 110 and a pair of opposing end plates 112, 114. Wall 110 has an exterior surface 35 and an interior surface 118 opposite surface 35. Surface 35 is in contact with and supports substrate 12 (shown in FIG. 1). Because wall 110, including surfaces 118 and 34, is formed from a highly thermally conductive material, such as aluminum, heat is thermally conducted through wall 110 and absorbed by substrate 12 (shown in FIG. 1).

End plates 112, 114 are fixedly coupled to wall 110 at opposite ends of roll 32. Wall 110 and side plates 112, 114 form a substantially enclosed interior which contains energy emitters 24.

Energy emitters 24 emit energy or heat to surface 118. Surface 118 conducts the heat through wall 110 to the substrate supported by surface 35. As best shown by FIG. 4, energy emitters 24 preferably include a plurality of distinct energy emitters 24*a*–24*i* disposed within roll 32 along the length of roll 32. Energy emitters 24*a*–24*i* preferably extend along the entire inner circumferential surface of roll 32 and are positioned side-by-side so as to extend along a substantial portion of the length of roll 32. Each energy emitter has a diameter comprised for sufficient encirculating the entire inner diameter of drum 32. As shown by FIG. 4, each energy emitter 24*a*–24*i* generally comprises an annular thin band having an outer surface 120 placed in direct physical contact with surface 118 of roll 32 by adjustment of expansion mechanisms 122. Expansion mechanisms 122 enable the diameter of each band heater to be adjusted to securely position surface 120 against surface 118 of roll 32. Each energy emitter 24*a*–24*i* preferably has a width of approximately two inches.

Each energy emitter 24*a*–24*i* is selectively controllable so as to selectively emit energy along the length of conductor roll 32. As a result, the amount of energy or heat conducted through wall 110 to the substrate supported by surface 35 may be selectively varied depending upon the character of the substrate and the coating applied to the substrate. For example, if the substrate upon which the coating is being dried has a reduced width relative to the length of roll 32, one or more of energy emitters 24*a*–24*i* may be selectively controlled so as to emit a lower amount of heat or no heat at all to save energy and to maintain better control over the drying of the coating upon the substrate. If selected portions of the substrate along the width of the substrate have varying types or amounts of coatings applied thereon which require different amounts of heat for adequate drying, energy emitters 24*a*–24*i* may be selectively controlled to accommodate each substrate portion'is specific coating drying requirements. As a result, energy emitters 24*a*–24*i* effectively dry coatings upon the substrate with less energy and with greater control of the heat applied to the substrate to provide for optimum drying times without damage such as burning or discolorization of the substrate.

In the preferred embodiment illustrated, energy emitters 24*a*–24*i* preferably comprise band heaters as are conventionally used for heating the inside diameter of large diameter blown film dies. Because energy emitters 24*a*–24*i* preferably comprise band heaters, the overall mass of roll 32 is low. As a result, roll 32 acts as an idler roll that rotates with movement of the substrate about roll 32 without a complex drive mechanism. Consequently, the manufacture, construction and cost of dryer system 10 is simpler and less expensive. The preferred band heaters are supplied by Watlow of St. Louis, Mo.

Although energy emitters 24*a*–24*i* are illustrated as being band heaters, energy emitters 24 may alternatively comprise any one of a variety of well known energy emitters such as resistive energy emitters, conductive energy emitters and radiant energy emitters. Examples of radiant energy emitters include tubular quartz infra-red lamps, quarts tube heaters, metal rod sheet heaters and ultraviolet heaters which emit radiation having a variety of different wave lengths and radiant energy levels. For example, energy emitters 24 may alternatively comprise a plurality of radiation emitting lamps aligned end to end along the length of roll 32 and positioned side by side around the entire inner surface of roll 32. As with the band heaters, selective control of the end-to-end radiation emitting lamps could be used to provide selected controlled heating of wall 110 and the substrate in contact with wall 110 along the length of roll 32.

Energy emitters 24*a*–24*i* receive power through slip ring assembly 25. As shown in FIG. 4, slip ring assembly 25 includes lead wire 119 which supplies power to energy emitters 24*c*, 24*f* and 24*i*. Slip ring assembly 25 also includes additional lead wires (not shown) for similarly supplying power to energy emitters 24*a*, 24*b*, 24*d*, 24*e*, 24*g*, 24*h*.

As further shown by FIG. 4, temperature sensors 30 include a plurality of individual temperature sensors 30*a*–30*i* corresponding to energy emitters 24*a*–24*i*. Temperature sensors 30*a*–30*i* preferably comprise conventionally known thermocouples supported adjacent to surface 35 of roll 32 so as to glide upon surface 35. Temperature sensors 30*a*–30*i* sense the temperature of roll 32 at surface 35 along the length of roll 32. Controller 31 (shown in FIG. 1) uses the temperature sensed by sensors 30*a*–30*i* to control energy emitters 24*a*–24*i*. As a result, sensors 30*a*–30*i* provide feed back for closed looped temperature control of energy emitters 24*a*–24*i* to precisely control the temperature of surface 35 along the entire length of roll 32. The surface temperature of surface 35 may be constant or selectively varied along the length of roll 32 based upon varying drying needs across the width of the substrate.

Figure 5:
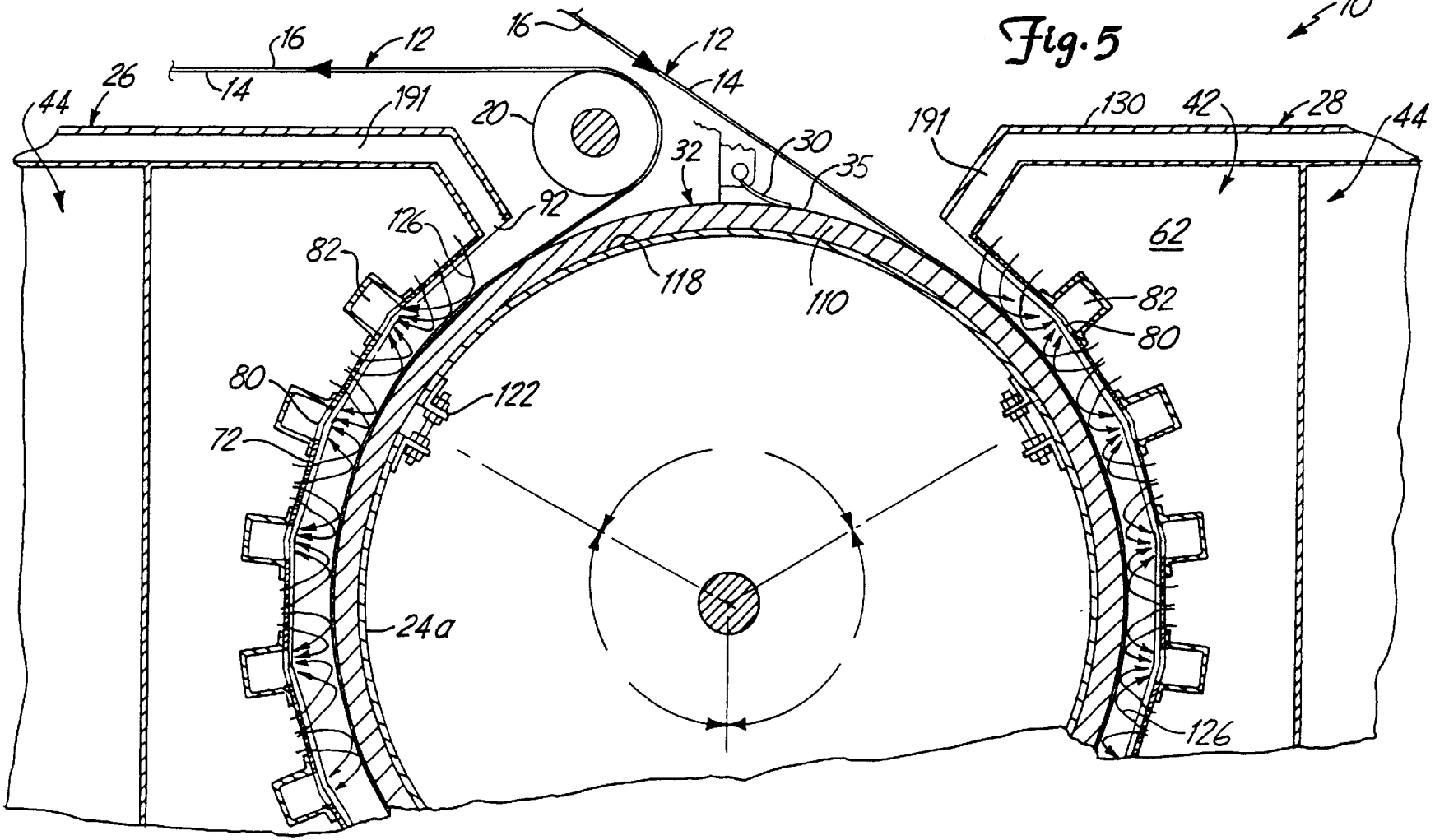
FIG. 5 is an enlarged fragmentary cross-sectional view of the dryer system.

FIG. 5 is an enlarged fragmentary cross-sectional view of dryer system 10. As best shown by FIG. 5, dryer system 10 includes an outer shell 130 that encloses convection units 26 and 28 and defines a dead air space 191 between convection units 26, 28 and shell 130 for insulating convection units 26, 28.

As further shown by FIG. 5, back surface 16 of substrate 12 is positioned in close physical contact with surface 35 of roll 32 between roll 32 and convection units 26 and 28. Energy emitter 24*a* (as well as the remaining energy emitters 24*b*–24*i* shown in FIG. 4) are positioned in close physical contact with surface 118 of drum 32 opposite substrate 12. Energy emitters 24 emit energy in the form of heat towards surface 35. This heat is conducted across the highly thermally conductive material forming wall 110 of roll 32 to back surface 16 of substrate 12. Substrate 12 absorbs this heat to convert the base of the coating applied to substrate 12, either a water or a solvent, into a vapor. At the same time, because surface 35 is highly thermally conductive, roll 32 conducts excessive heat away from areas on surface 14 of substrate 12 which do not carry wet coatings such as inks. As a result, the areas of substrate 12 not containing wet coatings do not burn from being over heated. At the same time, because roll 32 is also in contact with areas on the front surface 14 of substrate 12 containing wet coatings such as inks, roll 32 conducts the excessive heat back into these areas to decrease drying time and the amount of energy need to dry the coatings upon substrate 12.

To precisely control the surface temperature of surface 35, temperature sensors 30 glide over surface 35 to sense the temperature of surface 35 just prior to substrate 12 being wrapped about roll 32. As a result, energy emitters 24 may be precisely controlled based upon sensing temperatures from temperature sensors 30 to precisely control the surface temperature of surface 35 and the heat applied to substrate 12 by energy emitters 24 and roll 32.

At the same time that substrate 12 is absorbing heat conducted through roll 32 from energy emitters 24, substrate 12 is also absorbing heat from convection units 26 and 28. As indicated by arrows 126, outlets 72 direct the heated high pressure air within plenum 62 towards front surface 14 of substrate 12. As discussed above, outlets 72 are preferably sized and numbered so as to direct the heated high pressure air towards substrate 12 with a sufficient velocity and momentum so as to impinge upon front surface 14 of substrate 12 despite the relatively smaller vacuum or suction from inlets 80 of vacuum chamber 44. The heated air striking front surface 14 of substrate 12 delivers heat to the coatings upon substrate 12 to assist in the conversion of the water or solvent in the coating into a vapor to dry the coating upon the substrate 12. Once the heated air has impinged upon front surface 14 of substrate 12, the velocity and momentum of the air decreases substantially. At this point, the vacuum created by blower 48 within vacuum chamber 44 (shown in FIG. 2) draws the heated air through inlets 80 into channels 82 where the heated air is recirculated back to blower 48 for repressurization and reheating. As a result, once the heated air impinges upon substrate 12, the heated air is recycled by being recirculated back to blower 48 (shown in FIG. 2). As a result, a substantial portion of the heated air is returned to blower 48 for recirculation. Because a substantial portion of the heated air is not permitted to escape from dryer system 10 after impinging upon substrate 12, dryer system 10 does not need to heat as large of a volume of air and is therefore more energy efficient. Moreover, the suction created by blower 48 and vacuum chamber 44 also enables the heated air flowing through outlets 72 to effectively dry the coatings upon substrate 12 with less energy and in less time. Typical convection dryers simply rely upon atmospheric pressure to bleed off heated air once the heated air has impinged upon the coating being dried. It has been discovered that once the heated air strikes the coating and the substrate, the air forms a layer or cushion of air over the coating and substrate to create a mild back pressure. Consequently, this cushion or layer of air interferes with and inhibits higher velocity air from subsequently reaching and impinging upon the coating and substrate. The vacuum created through openings 80 of vacuum chamber 44 withdraws the heated air once the heated air strikes or impinges upon the coating and substrate to minimize or prevent the formation of the stagnant cushion of air over the coating and substrate. The vacuum created through inlets 80 of vacuum chamber 44 also removes vapor saturated air from adjacent the substrate and coating so that air having a lower relative humidity may strike the coating to further absorb released vapors.

To maintain a low relative humidity of the air within plenum 62 (preferably between about one to five percent relative humidity), an extremely small amount of the circulating air, preferably approximately forty cubic feet per minute, is permitted to escape through natural openings within dryer system 10. These natural openings occur between the outer walls of each convection unit 26, 28 which are preferably pop riveted together. Alternatively, a conventional exhaust system may be used for removing vapor saturated air to control the relative humidity of the air circulating within dryer system 10. Because dryer system 10 recirculates most of the heated air rather than permitting a large volume of the heated air to escape to the outside environment, the user does not need to remove a large volume of air conditioned air from the building to operate the system. As a result, dryer system 10 conserves energy.

Overall, dryer system 10 effectively dries coatings applied to a surface of the substrate at a lower cost with less energy and in a smaller amount of time. Because energy emitters 24 may be controlled to selectively emit energy along the length of roll 32, the amount of heat delivered along the length of roll 32 may be varied based upon varying drying requirements of the substrate and coating. Temperature sensors 30 further enable precise control of the surface temperature along the length of roll 32 to control the amount of heat delivered to substrate 12. As a result, the amount of heat applied to substrate 12 from energy emitters 24 may be controlled to effectively dry the coating upon substrate with the least amount of energy in the shortest amount of time. Because a vacuum created by blower 48 (shown in FIG. 2) within vacuum chamber 44 withdraws heated air from the substrate once the heated air impinges upon the substrate, dryer system 10 achieves more effective air circulation adjacent to the substrate and coatings to more effectively dry the coatings upon the substrate. In addition, because the heated air is recirculated, rather than being released to the environment, system 10 requires less energy for heating air to an elevated temperature and also saves on cooling costs for the outside environment.

In addition to drying coatings with less energy, dryer system 10 is more compact, simpler to manufacture and less expensive than typical drying systems. Due to the arrangement of pressure chamber 42 and vacuum chamber 44, dryer system 10 is compact and requires less space. Due to its simple construction and lightweight components, such as the band heaters comprising energy emitters 24, dryer system 10 is lightweight and easy to manufacture. Because energy emitters 24 preferably comprise band heaters, roll 32 and heaters 24 have an extremely low mass. As a result, roll 32 does not require a complex drive mechanism which increases both the cost of manufacture and the cost of operation. In sum, dryer system 10 provides a cost effective apparatus for drying wet coatings applied to the surface of the substrate.

Figure 6:
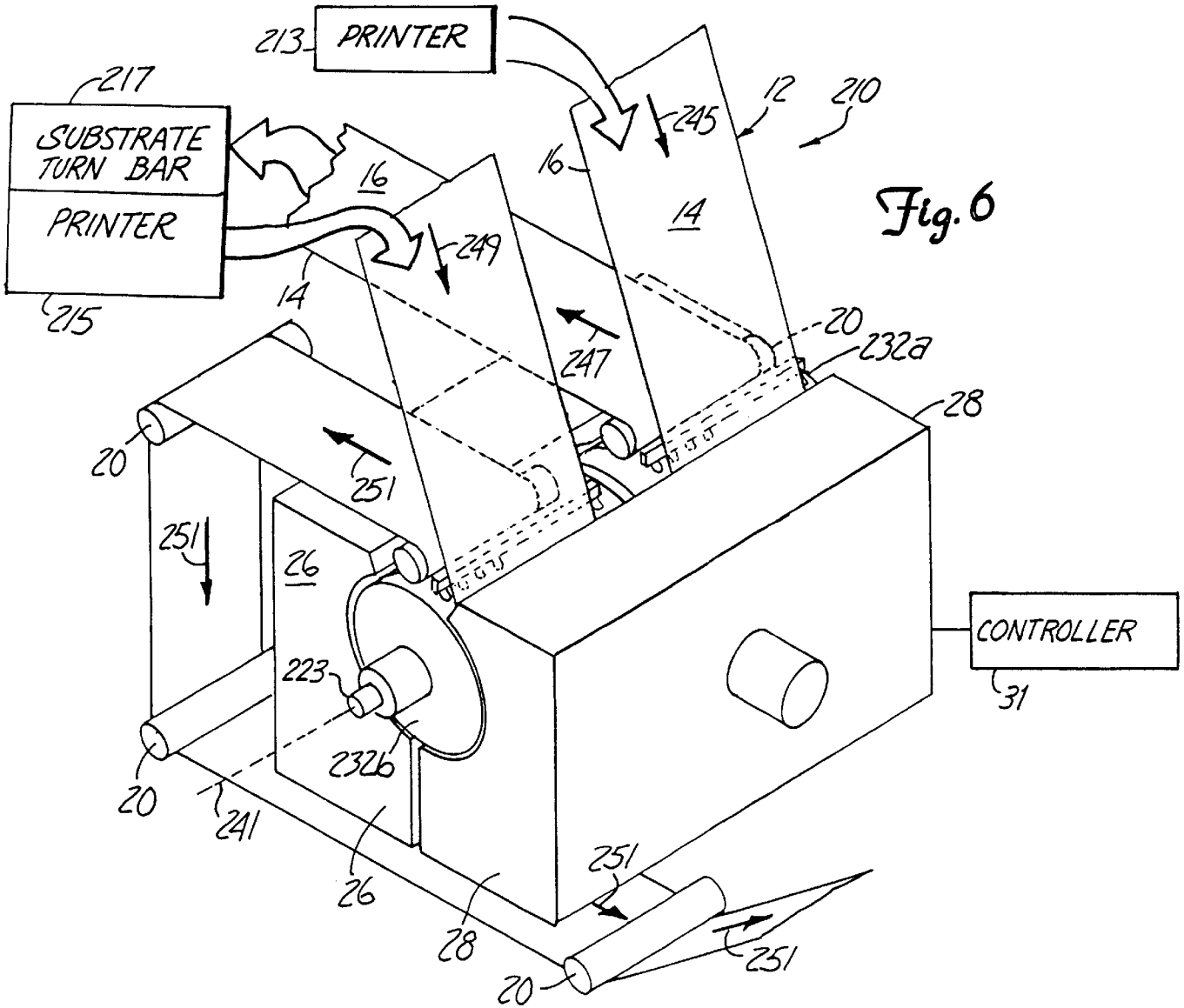
FIG. 6 is a schematic perspective view of an alternate embodiment of the dryer system.

FIG. 6 is a schematic perspective view of dryer system 210, an alternate embodiment of dryer system 10. Dryer system 210 additionally further includes printers 213 and 215 and a substrate turn bar 217. Dryer system 210 is substantially similar to dryer system 10 illustrated in FIGS. 1–5 except that dryer system 210 is alternatively configured for drying coatings applied to both surfaces, surface 14 and surface 16, of substrate 12. In particular, dryer system 210 includes a substrate support 22 including two rolls, rolls 232*a* and 232*b*. Rolls 232*a* and 232*b* are each substantially identical to roll 32 of dryer system 10. Rolls 232*a* and 232*b* each freely rotate about an axis 241 of a single axle 223. As with roll 32 (shown in FIGS. 1–5), rolls 232*a* and 232*b* each contain energy emitters 24 which emit energy that is conducted through rolls 232*a* and 232*b* to dry the coating on substrate 12. Because energy emitters preferably comprise band heaters, rolls 232*a* and 232*b* do not require complex space consuming drive mechanisms. Consequently, rolls 232*a* and 232*b* may be positioned end-to-end in relatively close proximity to one another. As a result, rolls 232*a* and 232*b* may be compactly positioned between convection units 26 and 28 for drying both sides of a substrate with a single drying unit. Temperature sensors 30 sense the temperatures of rolls 232*a* and 232*b* which is used by controller 31 to individually regulate energy emitters 24 within each roll 232*a* and 232*b*. Also with dryer system 10, dryer system 210 includes mirroring convection units 26 and 28 that arcuately surround a majority of rolls 232*a* and 232*b* to direct heated pressurized air with a selected velocity at the substrate 12 supported by rolls 232*a* and 232*b* to further deliver heat to the coatings. Once the heated air impinges upon substrate 12, the heated air is withdrawn and recirculate as described above.

In operation, printer 213 applies a coating to surface 14 of substrate 12. Substrate 12 is then advanced into a first end of convection unit 26 about roll 232*a* while heat is applied to the coating to dry the coating upon surface 14 of substrate 12, as indicated by arrow 245. Once the coating is dried upon surface 14 of substrate 12, substrate 12 is withdrawn from roll 232*a* as indicated by arrow 247. Once substrate 12 is withdrawn from roll 232*a*, substrate turn bar 217 preferably flips or overturns substrate 12 and printer 215 applies a second coating to surface 16 of substrate 12. As indicated by arrows 249, substrate 12 is then advanced about roll 232*b* with surface 14 in contact with roll 232*b* while the second coating applied to surface 16 is dried. Once the second coating has dried upon surface 16 of substrate 12, substrate 12 is withdrawn from between convection units 26 and 28 and is advanced about positioning rolls 20 as indicated by arrows 251 until substrate 12 reaches a second opposite side for further processing of substrate 12. Dryer system 210 provides for fast and efficient drying of a coating applied to both surfaces of a substrate with a single compact dryer unit.

Figure 7:
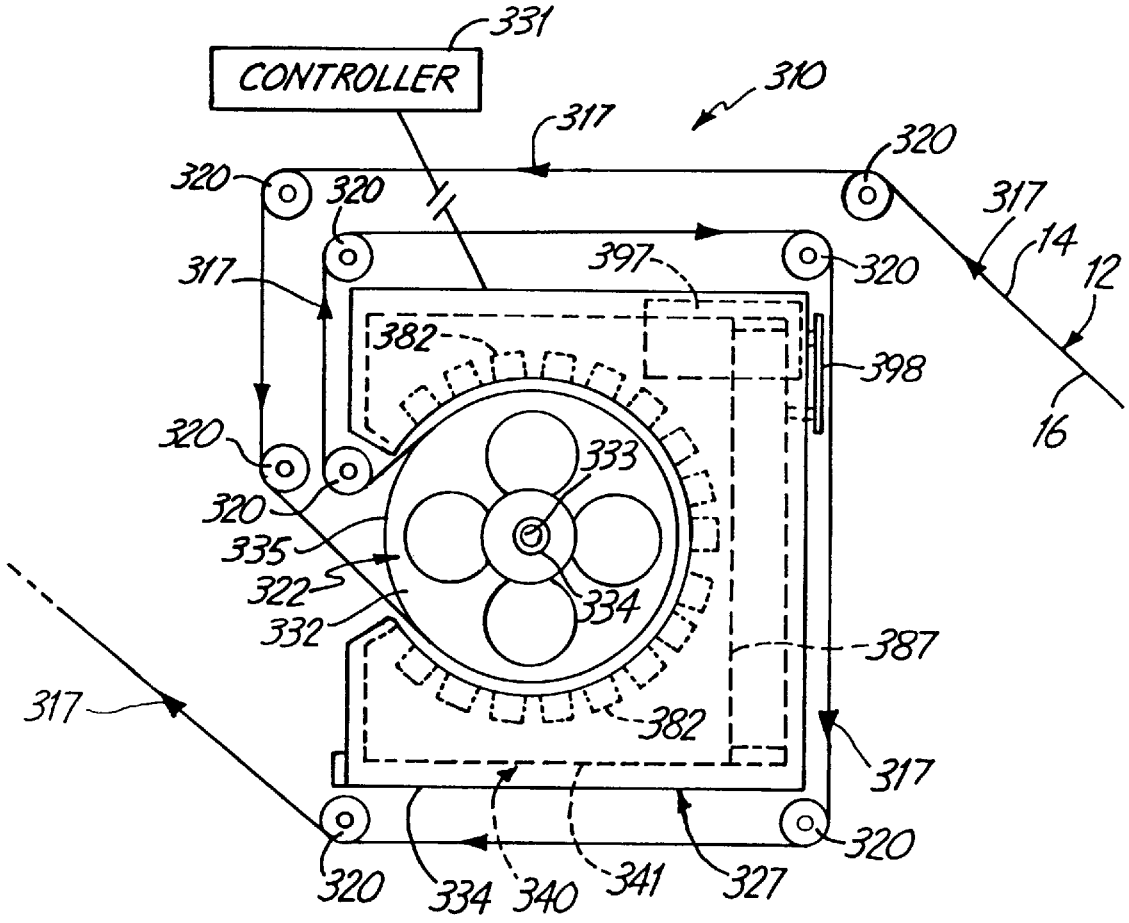
FIG. 7 is a side elevational view of a second alternative embodiment of a coating dryer system of the present invention.

FIG. 7 is a side elevational view of another alternative coating dryer system 310 for drying a coating applied to a substrate 12 having a front surface 14 and back surface 16. Arrowheads 317 on substrate 12 indicate the direction in which substrate 12, preferably a continuous web, is moving within coating dryer system 310. The system 310 is supported relative to a frame structure (not shown) which may or may not be enclosed. The frame structure also preferably supports positioning rolls 320, substrate support 322, convection housing 327 and controller 331. Controller 331 comprises a conventional control unit that includes both power controls and process controls. Controller 331 may be mounted on the frame structure adjacent the dryer system 310, or it may be mounted at a remote control panel for the substrate conveying stream process controls.

Positioning rolls 320 are rotatably coupled to the frame structure in locations so as to engage back surface 16 of substrate 12 to stretch and position substrate 12 about substrate support 322. Positioning rolls 320 preferably support substrate 12 so as to wrap substrate 12 greater than approximately 290° about substrate support 322 for longer dwell times and more compact dryer size. In addition, positioning rolls 320 guide and direct movement of substrate 12 through heater system 310.

Substrate support 322 engages back surface 16 of substrate 12 and supports substrate 12 within the convention housing 327. Substrate support 322 preferably includes roll 332, axle 333 and bearings 334. Roll 332 preferably comprises an elongate cylindrical drum or roll having a cylindrical outer surface 335 in contact with back surface 16 of substrate 12. Roll 332 is preferably formed from a material having a high degree of thermal conductivity such as metal. In the preferred embodiment, roll 332 is made from aluminum and has a thickness of about ⅜ of an inch. Preferably, surface 335 of roll 332 contacts the entire back surface 16 of substrate 12. Because roll 332 is formed from a material having a high degree of thermal conductivity, roll 332 conducts excess heat away from areas on the front surface 14 of substrate 12 which do not carry wet coatings such as inks. As a result, the areas of substrate 12 that do no contain a wet coating do not burn from being overheated during the drying process. At the same time, because roll 332 is also in contact with areas on the front surface 14 of substrate 12 containing wet coatings such as inks, roll 332 conducts the excess heat back into portions of substrate 12 containing wet coatings so that the coatings dry in less time. Axle 333 and bearings 334 rotatably support roll 332 with respect to the frame structure and in alignment with the convection housing 327. Although substrate support 322 preferably comprises a thermally conductive roll rotatably supported and aligned relative to convection housing 327, substrate support 322 may alternatively comprise any one of a variety of stationary or movable supporting structures having different configurations and made of different materials for supporting substrate 12 adjacent to the convection housing 327.

Figure 8:
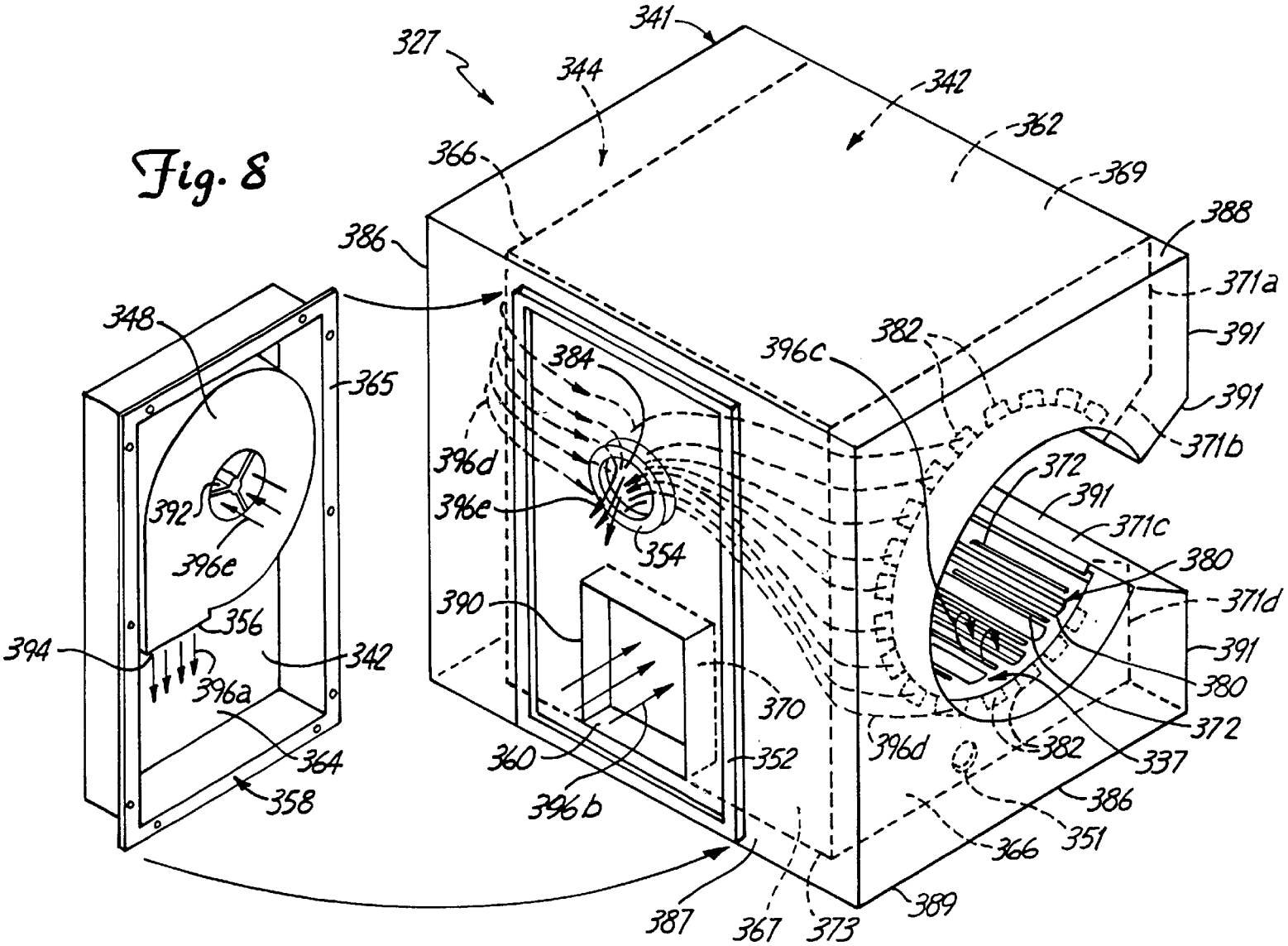
FIG. 8 is a perspective view of convection components of the inventive dryer system, as viewed from the rear, top and one side thereof, with portions exploded away.
Figure 9:
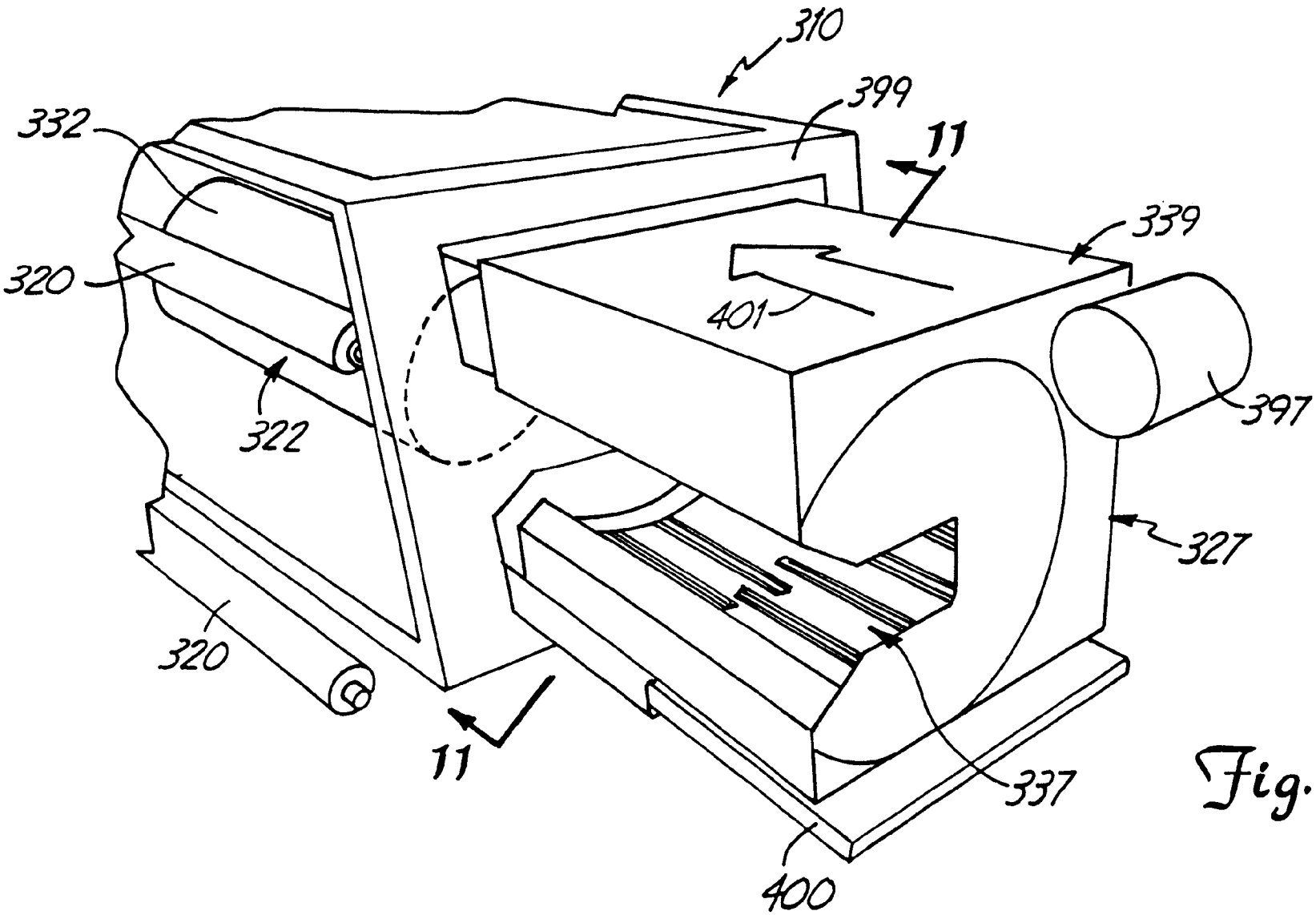
FIG. 9 is a perspective view of the second alternative embodiment in a maintenance position, adjacent a web travel path, as viewed from the front, top and one side thereof.

The convection housing 327 is further illustrated in FIGS. 8 and 9. The convection housing 327 extends about the roll 332 of substrate support 322. In the preferred embodiment illustrated, the convection housing 327 includes an arcuate panel member 337 extending substantially along the length of the roll 332 and configured so as to arcuately surround substrate 12 and roll 332 in close proximity with substrate 12. The arcuate panel member 337 extends approximately 290° about the cylindrical outer surface 335 of roll 332 for the application of drying energy to substrate 12 thereon in as large an arc as possible (and for the largest possible dwell time of the substrate 12 within the coating dryer system 310, thereby allowing the coating dryer system 310 to be more compact).

The convection housing 327 applies energy in the form of a heated gas to substrate 12 by impinging substrate 12 with heated dry air to dry the coating applied to substrate 12. After the heated dry air has impinged upon substrate 12, the convection housing 327 recycles the heated air by re-pressurizing the air and reheating the air, if necessary, to the preselected desired temperature before once again impinging substrate 12 with the recycled heated air. To recycle the heated air once the heated air impinges upon substrate 12, the convection housing 327 circulates the heated air to an inlet of the means for impinging substrate 12 with heated air. Although the dryer system 310 is shown with the convection housing formed as a single unit arcuately surrounding and positioned adjacent to substrate support 322 and substrate 12, the dryer system 310 may alternatively include two or more convection units adjacent to substrate support 322.

FIG. 8 is a perspective view of the convection housing 327, with some portions removed and a back portion exploded away for illustrative purposes. More specifically, an outer shell 339 of the convection housing 327 is shown in FIG. 7, along with an insulation layer 340 positioned between the outer shell 339 and an inner shell 341 of the convection housing 327. In FIG. 8, the outer shell 339 and insulation layer 340 are removed for clarity of illustration.

As best shown by FIG. 8, the exemplary embodiment of convection housing 327 generally includes pressure chamber 342, vacuum chamber 344, blower 348, one or more temperature sensors 351 and seals 352 and 354. Pressure chamber 342 is an elongate fluid or air flow passage through which pressurized air flows until impinging surface 12 (shown in FIG. 7). Pressure chamber 342 includes inlet 356, blower housing 358, duct 360 and plenum 362. Inlet 356 of pressure chamber 342 is generally the location in which pressurized air enters pressure chamber 342. In the preferred embodiment illustrated, inlet 356 comprises an outlet of blower 348. Alternatively, inlet 356 may comprise any fluid passage in communication between pressure chamber 342 and whatever conventionally known means or mechanisms are used for pressurizing air within pressure chamber 342.

Blower housing 358 is a generally rectangular shaped enclosure defining blower cavity 364 and forming flange 365. Flange 365 extends along an outer periphery of blower housing 358 and fixedly mounts against seal 352 to seal blower cavity 364 about duct 360. As a result, blower cavity 364 completely encloses and surrounds the outlet of blower 348 to channel and direct pressurized air from blower 348 through duct 360.

Duct 360 is a conduit extending between blower cavity 364 and an interior of plenum 362. Duct 360 provides an airtight passageway for pressurized air to flow from blower cavity 364 past vacuum chamber 344 into plenum 362.

Plenum 362 is a generally sealed compartment formed from a plurality of walls including side walls 366, rear wall 367, arcuate panel member 337, top wall 369, front walls 371*a*, 371*b*, 371*c* and 371*d* and bottom wall 373. The compartment forming plenum 362 is configured for containing the pressurized air and directing the pressurized air at substrate 12 and along roll 332 (shown in FIG. 1). In particular, arcuate panel member 337 defines an arcuate surface adjacent to and spaced from roll 332 (as shown in FIG. 1). Rear wall 367 defines an inlet 370, and arcuate panel member 337 defines a plurality of inlet slots 372. Inlet 370 is an opening extending through rear wall 367 sized for mating with duct 360 for permitting pressurized air from duct 360 to enter into plenum 362. Inlet slots 372 are apertures extending coaxially (relative to the axis of the roll 332) through the arcuate panel member 337 to communicate with an interior of plenum 362. Inlet slots 372 are preferably located an oriented so as to permit pressurized air within plenum 362 to escape through inlet slots 372 and to impinge upon substrate 12 before being recycled or recirculate by vacuum chamber 344.

Vacuum chamber 344 is an elongate fluid or air flow passage extending from substrate 12 adjacent roll 332 (shown in FIG. 7) to blower 348. Vacuum chamber 344 includes inlets 380, outlet troughs 382 and outlet 384. Inlets 380 are preferably interspersed among and between inlet slots 372 of pressure chamber 342 across the entire arcuate panel member 337 adjacent substrate 12 and roll 332 for uniform withdrawal of air across the surface of the substrate 12. Inlets 380 extend along the arcuate panel member 337 between its arcuate surface and the outlet troughs 382 therebelow. Each outlet trough 382 preferably comprises an elongated recess or trough extending laterally along the arcuate surface of arcuate panel member 337 and recessed radially outwardly from inlets 380 to provide fluid communication between vacuum chamber 344 and inlets 380. Outlet 384 of vacuum chamber 344 communicates between vacuum chamber 344 and an inlet of blower 348. As a result, blower 348 withdraws air from vacuum chamber 344 through outlet 384 to create the partial vacuum which draws heated air away from substrate 12 and roll 332 through inlets 380, once the heated air has impinged upon substrate 12.

In the preferred embodiment illustrated, vacuum chamber 344 include side walls 386, rear wall 387, top wall 388 and bottom wall 389. Side walls 386 are spaced from side walls 366 of plenum 362 while rear wall 387 is spaced from rear wall 367 of plenum 362 to define the fluid or air flow passage comprising vacuum chamber 344. A front wall 391 also serves to define a portion of the fluid or air flow passage comprising vacuum chamber 344 (and also in part defines front wall sections 371*a*, 371*b*, 371*c*, and 371*d* of the plenum 362). As a result of this preferred construction in which vacuum chamber 344 partially encloses plenum 362, side walls 366 and rear wall 367 of plenum 362 form a boundary of both plenum 362 and vacuum chamber 344 by serving as outer walls of plenum 362 and inner walls of vacuum chamber 344. Consequently, convection housing 327 is more compact and less expensive to manufacture.

As further shown by FIG. 8, rear wall 387 of vacuum chamber 344 supports seals 352 and 354 and defines outlet 384 and opening 390. Seal 352 is fixedly secured to an outer surface of rear wall 387 so as to encircle duct 360 and outlet 384 in alignment with flange 365 of blower housing 358. Seal 352 preferably comprises a foam gasket which is compressed between flange 365 and rear wall 387 to seal between blower housing 358 and duct 360.

Seal 354 is fixedly coupled to an exterior surface of rear wall 387 about outlet 384 of vacuum chamber 344. Seal 354 is also positioned so as to encircle an inlet of blower 348. Seal 354 (preferably a foam gasket) seals between outlet 384 of vacuum chamber 344 and the inlet of blower 348.

Opening 390 extends through wall 387 and is sized for receiving duct 360. Duct 360 extends between opening 390 within rear wall 387 and opening 370 within rear wall 367 of plenum 362. Duct 360 is preferably sealed to both rear walls 367 and 387 by welding. Alternatively, duct 360 may be sealed adjacent to both rear walls 367 and 387 by gaskets or other conventional sealing mechanisms so as to separate the vacuum created between rear walls 367 and 387 of vacuum chamber 344 and the high pressure air flowing through duct 360.

Blower 348 pressurizes air within pressure chamber 342 and creates the partial vacuum within vacuum chamber 344. Blower 348 generally comprises a conventionally known blower having an inlet 392 and an outlet 394. Blower 348 is preferably mounted within and partially through blower housing 358 so as to align inlet 392 with outlet 384 of vacuum chamber 344 surrounded by seal 354. As a result, blower 348 draws air from vacuum chamber 344 through outlet 384 of vacuum chamber 344 and through inlet 392 to create the partial vacuum within vacuum chamber 344.

Blower 348 expels air through outlet 394 to pressurize the air within pressure chamber 342. Outlet 394 of blower 348 also serves as the inlet 356 of pressure chamber 342.

Overall, blower 348 drives the current or flow of air by pressurizing air within pressure chamber 342 and by withdrawing air from vacuum chamber 344. As indicated by arrows 396*a,* air is discharged from blower 348 out opening 394 into blower cavity 364 to pressurize air within the blower cavity 364. The pressurized air flows from blower cavity 364 through duct 360 into plenum 362 as indicated by arrows 396*b.* Once within plenum 362, the pressurized air escapes through inlet slots 372 to impinge upon substrate 12 to assist in drying coatings upon substrate 12 as indicated by arrows 396*c.* Once the air has impinged upon substrate 12 (shown in FIG. 7), the vacuum pressure within vacuum chamber 344 draws the air into vacuum chamber 344 from substrate 12 through inlets 380. As indicated by arrows 396*d,* the vacuum pressure created at inlet 392 of blower 348 continues to draw the air through outlet troughs 382 and between side walls 366 and 386 and rear walls 367 and 387 until the air reaches outlet 384. Finally, as indicated by arrows 396*e,* the vacuum pressure created at inlet 392 of blower 348 sucks the air through outlet 384 of vacuum chamber 344 into inlet 392 of blower 348 where the air is once again recirculate. Blower 348 is driven by motor 397 which is coupled thereto by drive belt 398 and associated pulleys therefor (or other suitable drive means). The activation and operation of motor 397 (and hence blower 348) is controlled by controller 331.

In FIG. 9, an exemplary frame structure 399 for the coating dryer system 310 is illustrated. Roll 332 and positioning rolls 320 are rotatably supported on frame structure 399. Convection housing 327 is preferably supported upon sliding rail structure 400 which, in turn, is mounted on frame structure 399. As seen, the convection housing 327 has been slid axially or laterally out of the frame structure 399 along sliding rail structure 400 to permit access to arcuate panel member 337 thereof. Movement of the convection housing 327 in direction of arrow 401 repositions the convection housing 327 in position surrounding and along the roll 332 for drying of coatings on a web traversed thereby.

Figure 10:
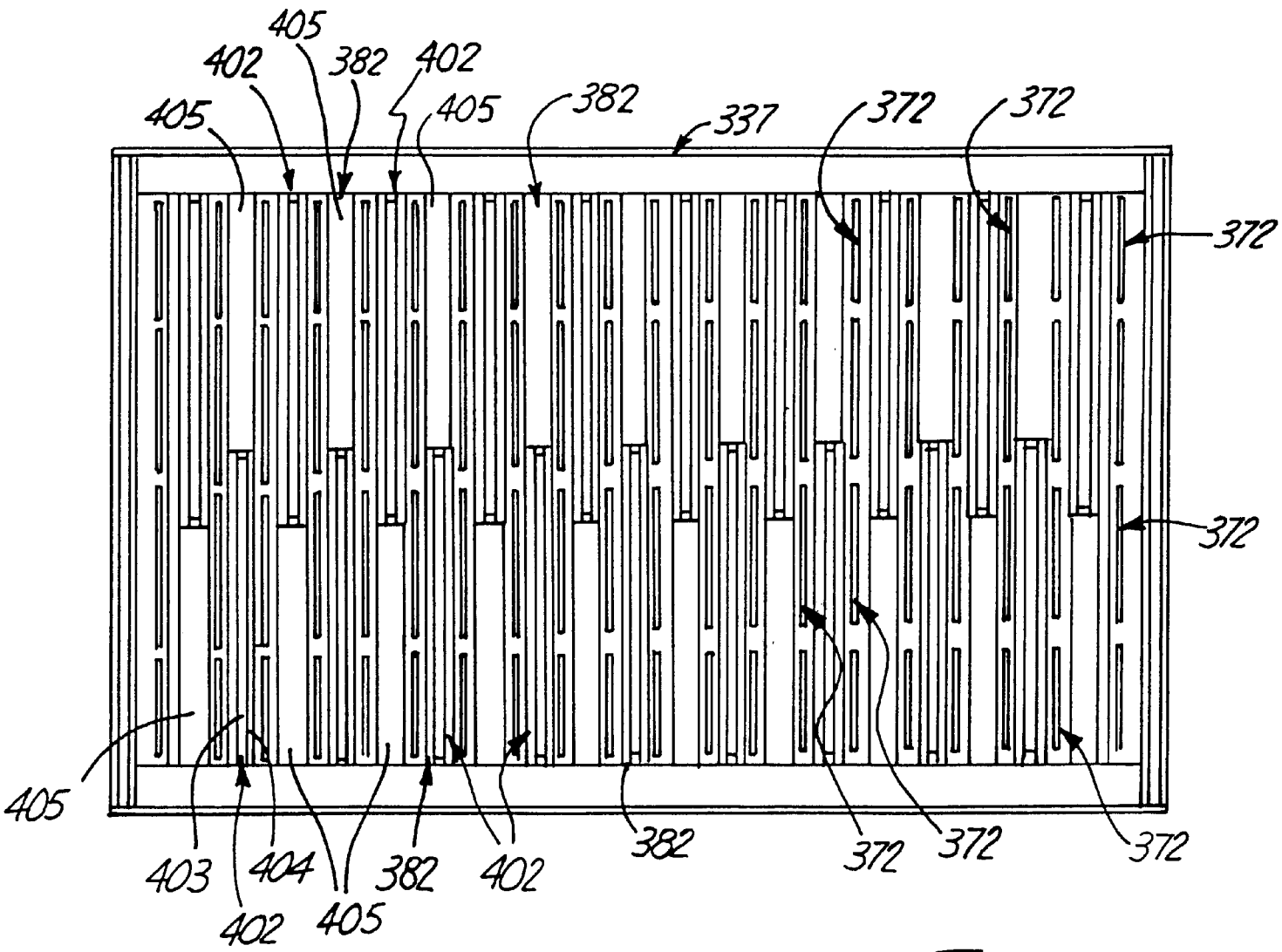
FIG. 10 is a generated planar view of an arcuate panel member of the convection components of the second alternative embodiment.

FIG. 10 is a flat, generated view of the arcuate panel member 337, and is provided to more fully illustrate the surface of the arcuate panel member 337 facing the substrate 12 and roll 332. The side-by-side arrangement of inlet slots 372 and outlet troughs 382 is more clearly shown in this representation. The inlet slots are aligned in parallel rows which extend coaxial with the axis of the roll 332 and perpendicular to the path of travel of the substrate 12. Preferably, a plurality of slots comprise each lateral roll of slots 372. The outlet troughs 382 also extend coaxially with the roll 332 axis and laterally across the travel path of the substrate 12, with each outlet trough 382 disposed between adjacent rows of inlet slots 372. In FIG. 10, each outlet trough 382 is covered by a lamp assembly 402 which includes the heating lamp bulb 403, reflective member 404 and trough cover 405.

While alternating inlets slots 372 and outlets 380/lamp assemblies 402 can be arranged for use on a single substrate travel path, FIG. 10 illustrates an arcuate panel member 337 which is sized for a pair of side-by-side rolls 332 (for a dryer system such as that shown in FIG. 6). Thus, along each side of the arcuate panel member 337, the lamp assemblies 402 are positioned in alternate troughs, with a trough cover 405 in place over the other outlet troughs 382 on that side of the arcuate panel member 337. The trough covers 405 serve to mask portions of the outlet troughs 382 and prevent airflow therethrough. Thus, air being recirculate must travel past the lamp bulbs 403 in order to enter the inlets 380 in the reflective members 404 and get into the outlet troughs 382. This arrangement is reversed on the other side of the arcuate panel member so that the lamp assemblies 402 are aligned in a laterally staggered pattern across the surface of the arcuate panel member 337. Preferably, the heating filaments of the heating lamp bulbs 403 do not overlap adjacent the lateral center of the arcuate panel member 337 in order to minimize energy spillover from one web path to the other web path (thereby maintaining the discrete heating functions for each of the separate side-by-side rolls in a duplex coating dryer system of the type shown in FIG. 6). The lamp assemblies 402 and related air flows for each of the separate side-by-side rolls are separately controlled in operation by controller 331. While a side-by-side arrangement is illustrated, it is contemplated that a number of alternative configurations will work to achieve the desired end, and it is not intended that the invention be limited by way of mere illustration.

Figure 11:
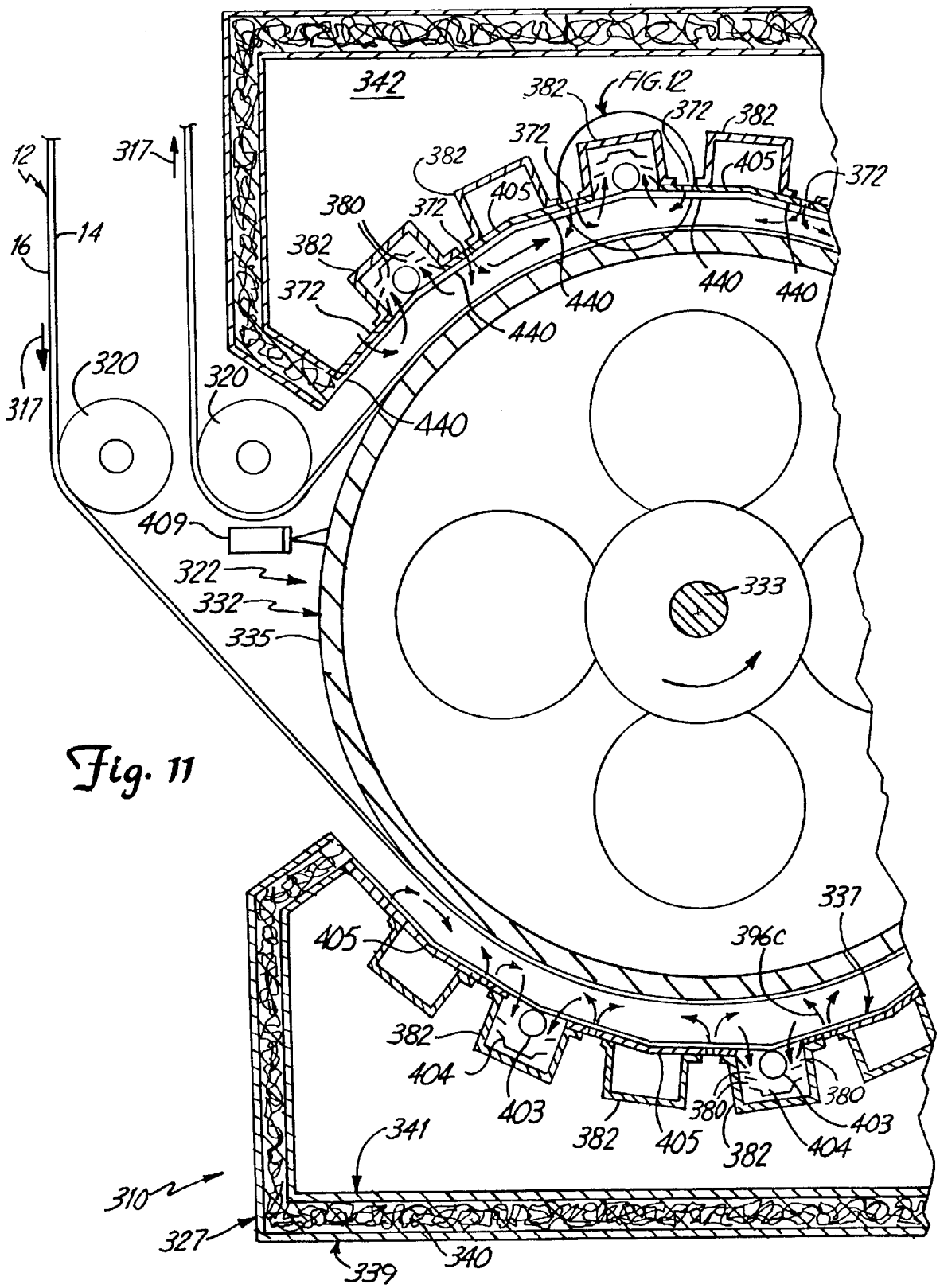
FIG. 11 is a sectional view as taken along lines 11—11 in FIG. 9.

As perhaps best shown in FIG. 11, the arcuate panel member 38 is actually comprised of a plurality of laterally extending planar facets 440 which are angled with respect to one another to define an arcuate surface about the roll 332. Each facet 440 includes a plurality of the inlet slots 372 which are preferably uniformly dispersed along the length of each facet 440 and among the facets 440 to establish an inlet array that provides uniform air flow to substrate 12 (shown in FIG. 7). As discussed herein with respect to other embodiments, the inlet array is preferably configured to optimize heat and mass transfer with convection flow.

In the preferred embodiment illustrated in FIG. 10, arcuate panel member 337 is approximately 450 square inches in surface area and is uniformly spaced from surface 335 of roll 332 (shown in FIG. 7) by approximately one inch. Blower 348 preferably creates approximately 4 inches of water static pressure within plenum 362. Due to minimal losses of air from convection housing 327, blower 348 also creates approximately one inch of vacuum within vacuum chamber 344. Arcuate panel member 337 includes 20 rows of laser cut inlet slots 372, with each row having approximately 22 inches of slot length, and each slot being approximately 0.025 inches thick. In the preferred embodiment of convection housing 327, air flows out of each inlet slot at a velocity of approximately 7000 feet per minute. As can be appreciated, the desired velocity of air flow is dependent upon the particular substrate and particular coating applied to the substrate.

Figure 12:
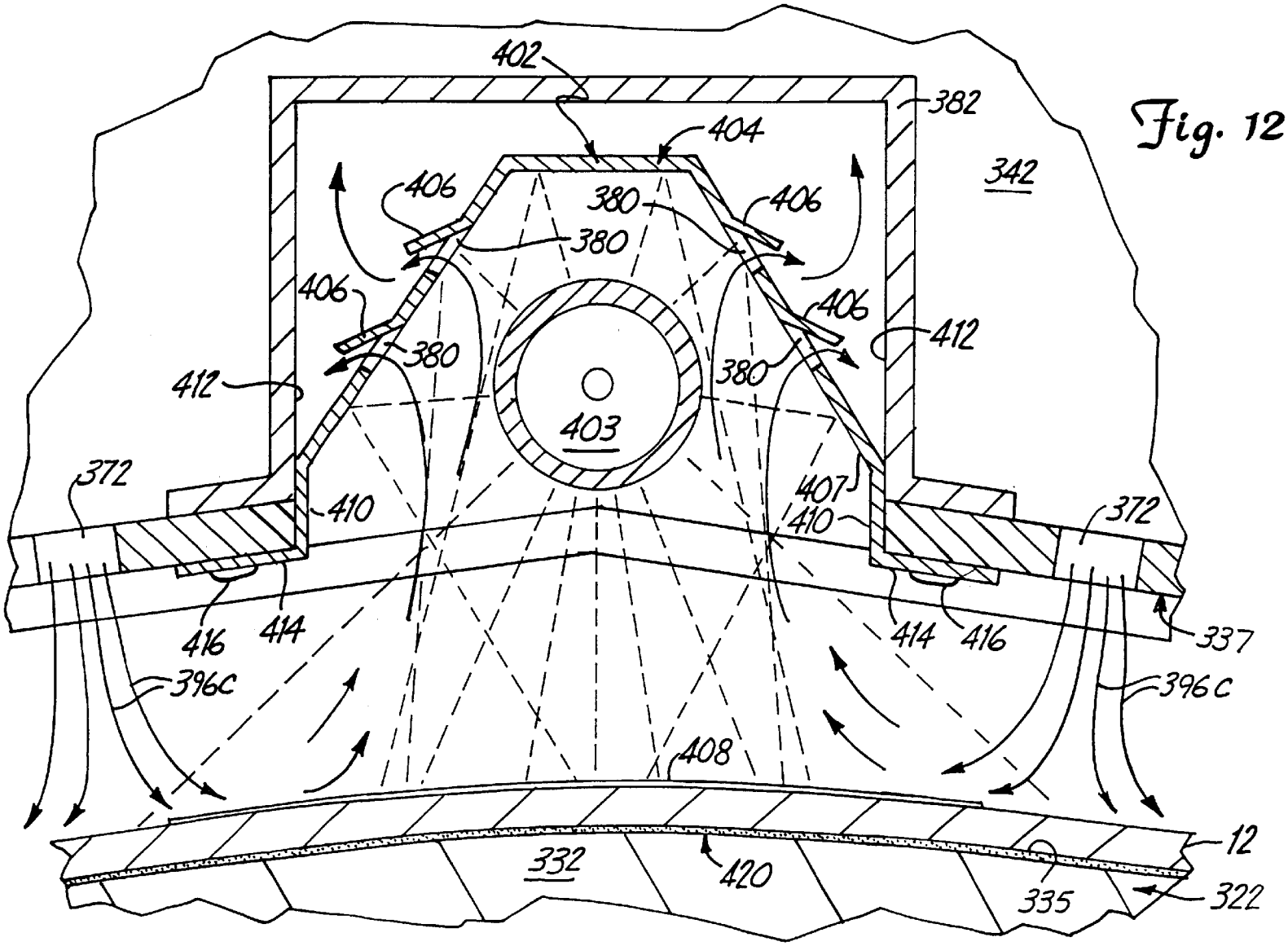
FIG. 12 is an enlarged view of the circular portion labeled "FIG. 12" in FIG. 11.

As illustrated in FIGS. 11 and 12, inlets 380 are formed as openings in the reflective member 404. Preferably, these openings are slots extending laterally across the path of the substrate 12 in communication with the outlet troughs 382 behind arcuate surface panel 337. Inlets 380 communicate between arcuate panel member 337 and vacuum chamber 344 so that the partial vacuum created by blower 348 in vacuum chamber 344 draws air into vacuum chamber 344 through inlets 380 once the air has initially impinged upon the substrate 12.

Inlets 380 are preferably sized as large as possible while maintaining the structural integrity of the reflective member 404 and while also providing an adequate number of appropriately sized inlets 380 therethrough. Because inlets 380 are preferably sized as large as possible, inlets 380 permit the vacuum created by blower 348 within vacuum chamber 344 to draw a larger volume of air from along the substrate 12 into vacuum chamber 344 to minimize losses of air from the convection housing 327. Forming the inlets 380 as large as possible also aids in minimizing back pressure. As best seen in FIG. 12, inlets 380 are preferably formed as slots with punched tabs or louvers 406 associated therewith. The reflective member 404 is preferably formed from an aluminum sheet which is highly polished on its reflective side 407 so that radiation emitted from the heating lamp bulb 403 is directed toward the substrate 12 and wet coating 408.

In the preferred embodiment illustrated, each inlet 380 is 0.10 inches wide and 0.50 inches long, and there are 960 inlets 380 across the surface of the arcuate panel member 337. As a result, the arcuate panel member 337 has approximately 48 square inches of vacuum inlets. The arcuate panel member also has approximately 6.6 square inches of pressurized inlet slots 372. The ratio of inlet area to outlet area across the arcuate panel member 337 (i.e., the ratio of pressure to vacuum orifice area) is approximately 0.14:1. In other words, for every square inch opening in communication between substrate 12 and pressure chamber 342, the arcuate panel member 337 has approximately 7.3 square inches of openings communicating between substrate 12 and vacuum chamber 344. This ratio of pressure chamber outlet opening to vacuum chamber inlet opening enables convection housing 327 to sufficiently impinge substrate 12 with air while adequately withdrawing air from substrate 12 to minimize the loss of air from convection housing 327 and to also improve drying efficiency by minimizing air pressure stagnation along substrate 12.

In one preferred embodiment, the lamp assemblies 402 are the sole means for heating the air being channeled through the convection housing 327. The heating lamp bulb 403 provides radiant heat energy to the substrate 12 as it passes thereby (by direct and reflected radiant energy), and also heats the air as it moves past the lamp bulb 403 and into the outlet trough 382 for recirculation by blower 348. The rapid movement of air past the heating lamp bulb 403 also serves to cool the lamp bulb 403 and its supportive fittings. Preferably, the lamp bulb is a Model No. 150072 Phillips HeLeN infrared halogen lamp, 1000 watts, T3 lamp, rated at 240 volts (having an overall length of approximately 13 inches, a lighted length of about 10 inches and a diameter of about ⅜ inches), available from Phillips Lighting.

The lamp assemblies 402 are shaped to be readily received and removable within the outlet troughs 382. As best seen in FIG. 12, side walls 410 of each reflective member 404 at least partially abut against side walls 412 of its respective outlet trough. Each reflective member 404 has side flanges or a plurality of side tabs 414 which are adapted to extend along the surface of the arcuate panel member 337 adjacent the opening of its respective outlet trough 382. Suitable fasteners 416 (e.g., sheet metal screws) are used to secure the tabs 414 of the reflective member 404 to the arcuate panel member 337, as seen in FIG. 12. Each trough cover 405 is likewise removably secured in place over its respective outlet trough 382. This arrangement provides for easy assembly and defines a modularity for the components for the coating dryer system 310, allowing its ready conversion to alternative dryer configurations, as disclosed herein. Each reflective member 404 and trough cover 405 is secured to the arcuate panel member 337 and defines a seal thereto along its edges and ends so that the passage of air into the outlet trough 382 must take place through the inlets 380.

The coating dryer system 310 thus provides radiant and convection heating means for the substrate 12 and coatings 408 thereon. While not illustrated in this embodiment, other additional heating means may be provided for drying the coatings 408 on the substrate 12, including further heaters in the air stream or energy emitters within the roll 32, such as those energy emitters 24 shown on the roll 32 in FIGS. 4 and 5.

In a preferred embodiment, the surface 335 of roll 332 has a coating 420 thereon to assist in dissipation of vapors from the substrate 12 (see FIG. 12). Preferably, coating 420 is a thin, thermally conductive and roughened coating on the cylindrical outer surface 335 of roll 332. In one embodiment, coating 420 is formed as a two-part coating, with a first layer of tungsten carbide particles, and a second layer of silicone-based release coating material which provides a good grip on the substrate, with a somewhat roughened texture so that water vapors can migrate away from the substrate. Such coatings are available from Plasma Coatings Inc., Bloomington, Minn., and the preferred coating is more specifically identified as a PC-914 coating. In one embodiment, coating 420 is relatively dark (i.e., black or some other dark color) to more fully absorb infrared energy emitted from the heating lamp bulbs 403 and reflected onto the roll 332 by the reflective member 404.

The operation of the lamp assemblies 402 and other possible heating assemblies are controlled by the controller 331. One or more temperature sensors are provided to sense the temperature of the surface 335 of the roll 332. One such sensor 409 is illustrated in FIG. 11 as an optical sensor, although contact temperature sensors (such as sensors 30 shown in FIGS. 4 and 5) may suffice. Inputs are provided to the controller relative to the substrate 12 and its desired coatings 408, and operational inputs are provided from temperature sensors 351 and 409 so that the desired air temperature and dwell time for the substrate within the convection housing 327 is achieved. Preferably, temperature sensor 351 is a thermocouple mounted within plenum 362, and more preferably, temperature sensor 351 is mounted within pressure chamber 342 and adjacent the inlet slots 372 to ascertain the heated air temperature just prior to its impingement on substrate 12. The preferred air temperature will vary depending upon the application, but temperature ranges (as measured in pressure chamber 342) of 150–225° F. are contemplated. Additional temperature sensors 351 located within the air stream in convection housing 327 may also be desired, such as within outlet troughs 382 or adjacent blower 348, for example. The temperature sensed by temperature sensors 351 are used by controller 331 to regulate the energy emitted by the heating lamp bulbs 403. As a result, the dryer system 310 thus provides closed-loop feedback control of the energy applied to substrate 12.

FIG. 11 is an enlarged fragmentary cross-sectional view of coating dryer system 310. As best shown in FIG. 11, dryer system 310 includes an outer shell 339 that encloses convection unit 327 and defines a space between an inner shell 341 thereof for reception of insulating material 340, such as Melamine polymeric foam sheeting available from Accessible Products Co., Tempe, Ariz.

As further shown by FIG. 11, back surface 16 of substrate 12 is positioned in close physical contact with surface 335 of roll 332 between roll 332 and convection housing 327. Heat energy emitted by the lamp assemblies 402 is absorbed by substrate 12, as well as roll 332. Substrate 12 absorbs this heat to convert the base of the coating 408 applied to substrate 12, either a water or a solvent, into a vapor. At the same time, because surface 335 is highly thermally conductive, roll 332 conducts excessive heat away from areas on surface 14 of substrate 12 which do not carry wet coating such as inks. As a result, the areas of substrate 12 not containing wet coatings do not burn or blister from being overheated. At the same time, because roll 332 is also in contact with areas on the front surface 14 of substrate 12 containing wet coatings such as inks, roll 332 conducts the excessive heat back into those areas to decrease drying time and the amount of energy needed to dry the coatings 408 upon substrate 12.

To precisely monitor and control the surface temperature of surface 335, one or more temperature sensors 409 sense the temperature of surface 335 just prior to substrate 12 being wrapped about roll 332. As a result, the heat energy output from lamp assemblies 402 may be precisely controlled based upon sensing temperatures from temperature sensors 409 in order to precisely control the surface temperature of surface 335 and the heat applied thereto and to substrate 12 by lamp assemblies 402.

At the same time that substrate 12 is absorbing heat conducted through roll 332, substrate 12 is also absorbing radiant heat from lamp assemblies 402 and heat by means of convection from the heated air passing thereover from convection housing 327. As indicated by arrows 396*c,* inlet slots 372 direct the heated high pressure air within plenum 362 toward front surface 14 of substrate 12. As discussed above, inlet slots 372 are preferably sized, shaped and numbered so as to direct the heated high pressure air toward substrate 12 with a sufficient velocity and momentum so as to impinge upon front surface 14 of substrate 12 despite the relatively smaller vacuum or suction from inlets 380 of vacuum chamber 344. The heated air striking front surface 14 of substrate 12 delivers heat to the coatings 408 upon substrate 12 to assist in the conversion of the water or solvent in the coating 408 into a vapor to dry the coating 408 upon the substrate 12. Once the heated air has impinged upon front surface 14 of substrate 12, the velocity and momentum of the air decreases substantially. At this point, the vacuum created by blower 348 within vacuum chamber 344 (shown in FIG. 8) draws the heated air through inlets 380 in the reflective member 404 and into the outlet troughs 382, where the heated air is recirculate back to blower 348 for repressurization and reheating. As a result, once the heated air impinges upon substrate 12, the heated air is recycled by being recirculate back to blower 348 (shown in FIG. 8). Thus, a substantial portion of the heated air is returned to blower 348 for recirculation. Because a substantial portion of the heated air is not permitted to escape from coating dryer system 310 after impinging upon substrate 12, dryer system 310 does not need to heat as large a volume of air and is therefore more energy efficient. Moreover, the suction created by blower 348 in vacuum chamber 344 also enables the heated air flowing through inlet slots 372 to effectively dry the coatings 408 upon substrate 12 with less energy and in less time. Lamp assemblies 402 may be controlled to selectively emit energy along the roll 332, and the amount of heat delivered may be varied based upon varying drying requirements of the substrate and coating. Temperature sensors 409 further enable precise control of the surface temperature along the roll 332 to control the amount of heat delivered to substrate 12. As a result, the amount of heat applied to substrate 12 may be controlled to effectively dry the coating upon substrate 12 with the least amount of energy and in the shortest amount of time. Because the vacuum created by blower 348 (shown in FIG. 8) within vacuum chamber 344 withdraws heated air from the substrate 12 once the heated air impinges upon the substrate 12, coating dryer system 310 achieves more effective air circulation adjacent to the substrate 12 and coatings thereon to more effectively dry the coatings upon the substrate 12. In addition, because the heated air is recirculate rather than being released to the environment, dryer system 310 requires less energy for heating air to an elevated temperature and also saves on cooling costs for the outside environment.

In addition to drying coatings with less energy, coating dryer system 310 is more compact, simpler to manufacture and less expensive then typical drying systems. Due to the arrangement of pressure chamber 342 and vacuum chamber 344, dryer system 310 is compact and requires less space. Due to its simple construction and lightweight components, dryer system 310 is lightweight and easy to manufacture. In sum, dryer system 310 provides a cost-effective apparatus for drying wet coatings applied to the surface of a substrate.

Typical convection dryers simply rely upon atmospheric pressure to bleed off heated air once the heated air has impinged upon the coating being dried. It has been discovered that once the heated air strikes the coating and substrate, the air forms a layer or cushion of air over the coating and substrate to create a mild back pressure. Consequently, this cushion or layer of air interferes with and inhibits higher velocity air from subsequently reaching and impinging upon the coating and substrate. The vacuum created through inlets 380 of vacuum chamber 344 withdraws the heated air once the heat air strikes or impinges upon the coating and substrate to minimize or prevent the formation of the stagnant cushion of air over the coating and substrate. The vacuum created through inlets 380 of vacuum chamber 344 also removes vapor-saturated air from adjacent the substrate and coating so that air having a lower relative humidity may strike the coating to further absorb released vapors.

To maintain a low relative humidity of the air within plenum 362 (preferably less than 15% relative humidity), an extremely small amount of circulating air, preferably approximately 40 cubic feet per minute, is permitted to escape through natural openings within dryer system 310. These natural openings occur between the walls of convection housing 327, which are preferably pop riveted together. Alternatively, a conventional exhaust system may be used for removing vapor-saturated air to control the relative humidity of the air circulating within coating dryer system 310. Because dryer system 310 recirculates most of the heated air rather than permitting a large volume of the heated air to escape to the outside environment, the user does not need to remove a large volume of conditioned air from the building to operate the system. As a result, coating dryer system 310 conserves energy.

Overall, coating dryer system 310 effectively dries coatings applied to a surface of the substrate at a lower cost with less energy and in a smaller amount of time. Lamp assemblies 402 may be controlled selectively to emit energy along the roll 332, and the amount of heat delivered may be varied based upon varying drying requirements of the substrate and coating. Temperature sensors 409 further enable precise control of the surface temperature along the roll 352, to control the amount of heat delivered to substrate 12. As a result, the amount of heat applied to substrate 12 may be controlled to effectively dry the coating upon substrate 12 with the least amount of energy and in the shortest amount of time. Because the vacuum created by blower 348 (shown in FIG. 8) within vacuum chamber 344 withdraws heated air from the substrate 12 once the heated air impinges upon the substrate 12, coating drying system 310 achieves more effective air circulation adjacent to the substrate 12 and coatings thereon to more effectively dry the coatings upon the substrate 12. In addition, because the heated air is recirculate, rather than being released to the environment, dryer system 310 requires less energy for heating air to an elevated temperature also saves on cooling costs for the outside environment.

In addition to drying coatings with less energy, coating dryer system 310 is more compact, simpler to manufacture and less expensive than typical drying systems. Due to the arrangement of pressure chamber 342 and vacuum chamber 344, dryer system 310 is compact and requires less space. Due to its simple construction and lightweight components, dryer system 310 is lightweight and easy to manufacture. In sum, dryer system 310 provides a cost-effective apparatus for drying wet coatings applied to the surface of a substrate.

Figure 13:
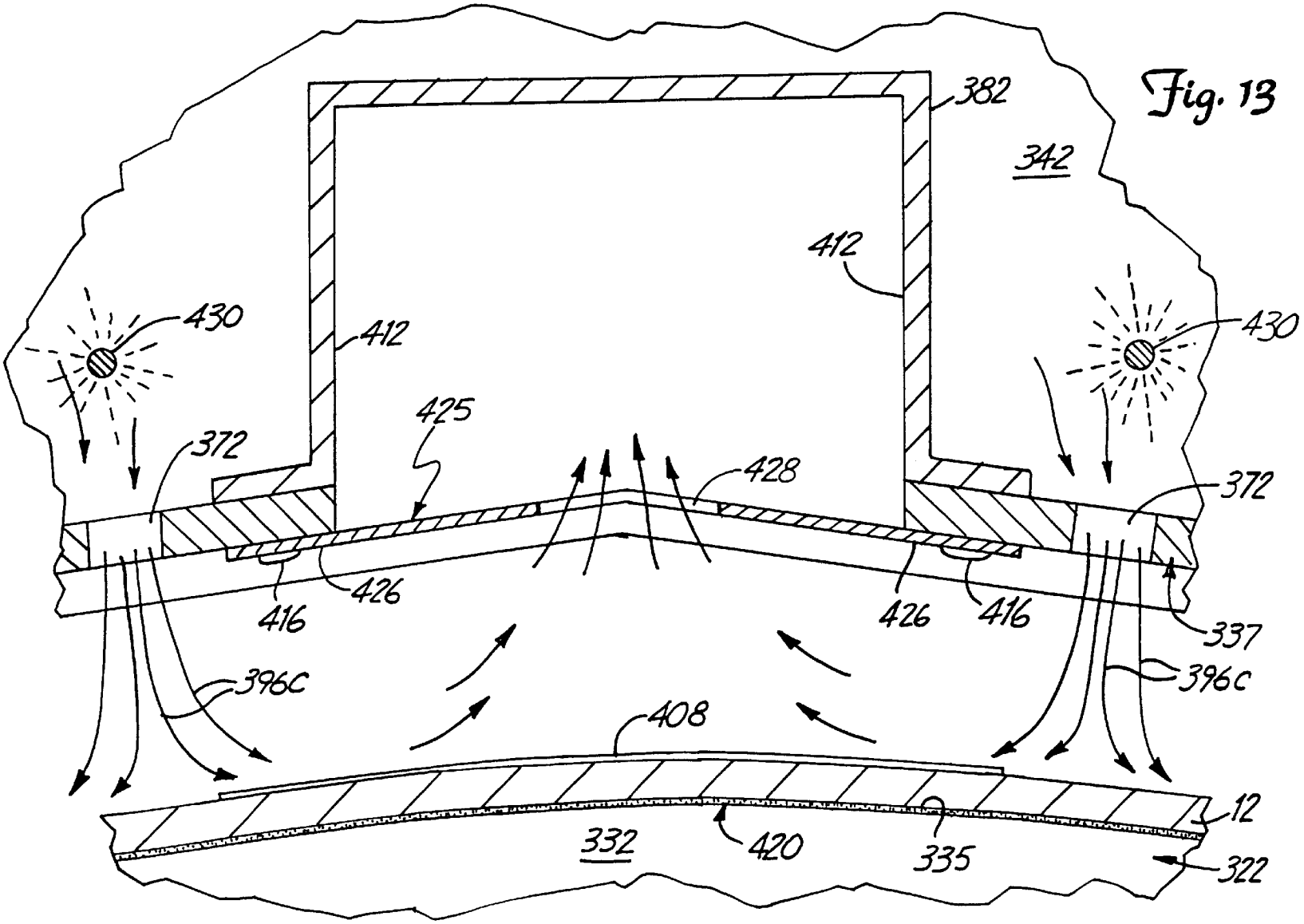
FIG. 13 is an enlarged sectional view of one of the trough outlets in the arcuate panel member of a third alternative embodiment of the coating dryer system of the present invention.
Figure 14:
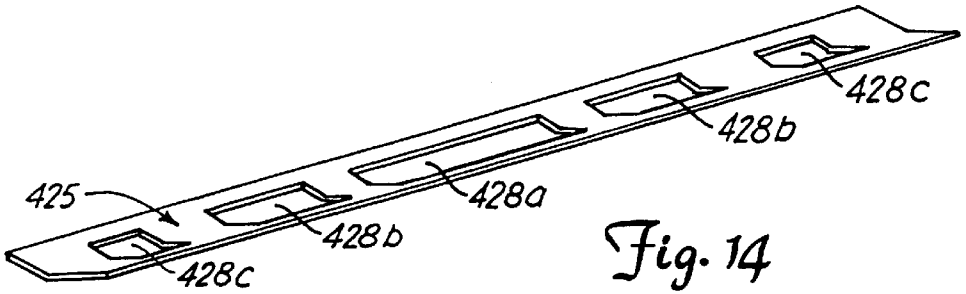
FIG. 14 is a perspective view of a trough cover plate used to define a portion of the arcuate panel member of the third alternative embodiment.
Figure 15:
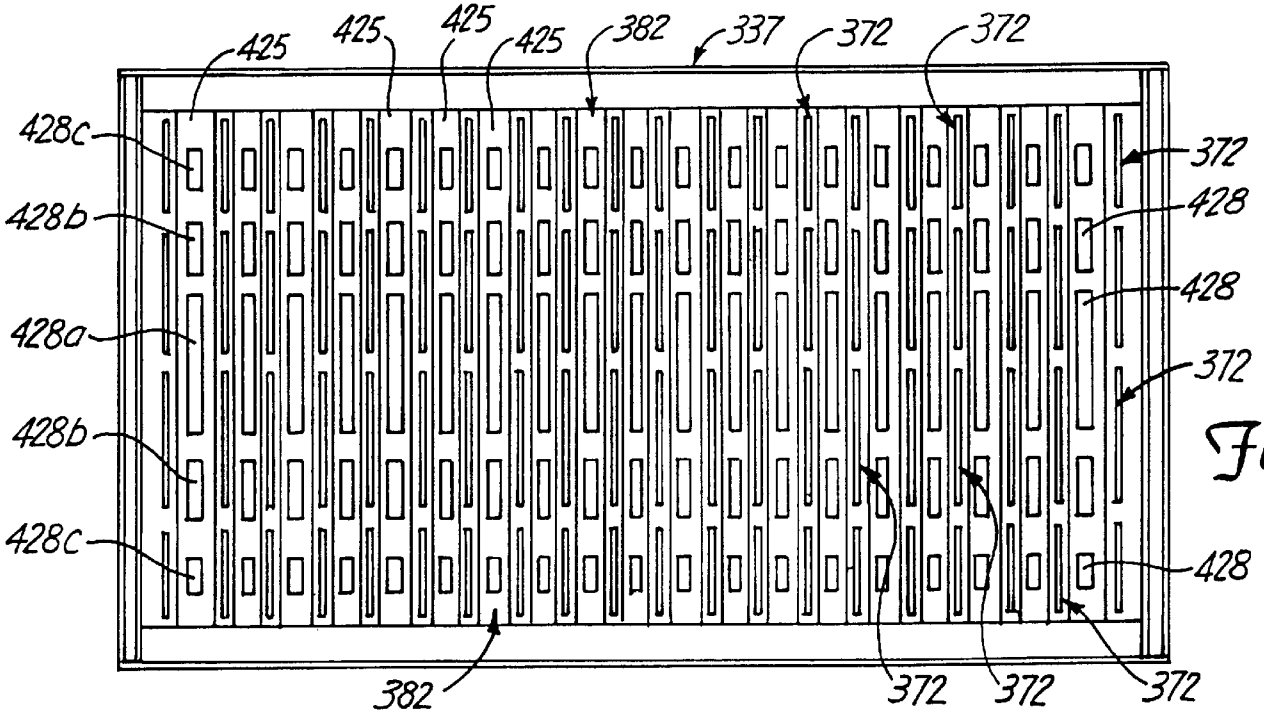
FIG. 15 is a generated planar view of the arcuate panel member of the third alternative embodiment.

An alternative embodiment for attaining convection heat and diverting the air flow related thereto is illustrated in FIGS. 13–15. In this embodiment, lamp assemblies 402 are eliminated and radiant heat is not used to dry the coatings 408 on the substrate 12. Instead, all heat for drying is provided by means of convection from heated air (and incidental conduction from roll 332). Instead of alternating arrays of lamp assemblies 402 and trough covers 405, trough cover panel 425 is fitted over each of the outlet troughs 382, as illustrated in FIGS. 13 and 15. Each trough cover panel 425 is sized to cover an entire outlet trough 382, and has side flanges or tabs 426 which, in cooperation with fasteners 416, allow securement of the trough cover panel 425 to the arcuate panel member 337. Each trough cover panel 425 is removable by means of fasteners 416, but once in place, it is sealed to its respective outlet trough 382 about the edges of its sides and ends.

As shown in FIGS. 14 and 15, each trough cover panel 425 has a plurality of apertures 428 therethrough. The apparatus 428 are shaped, spaced apart and sized to achieve a relatively uniform flow of heated air into the outlet troughs 382. For instance, as illustrated in FIGS. 14 and 15, a larger aperture 428*a* is positioned adjacent the center portion of each trough cover panel 425 with a pair of smaller apertures 428*b* adjacent thereto. A further pair of yet again smaller apertures 428*c* are spaced from the apertures 428*b*. The relative size, shape and spacing of the apertures 428 is intended to minimize the presence of an air flow gradient laterally across each outlet trough (i.e., created uniform air flow into the outlet trough across its entire lateral dimension). Preferably, the apertures 428 define 48 square inches of outlet, as compared to the 6.6 square inches of air inlet defined by the inlet slots 372 (for an outlet to inlet ratio of approximately 1:0.14.

In this embodiment, the preferred means for heating the air is by the use of a plurality of rod heaters 430 disposed within convection housing 327. Preferably, a rod heater 330 is provided within the pressure chamber 342 adjacent and just behind each row of inlet slots 372. The rod heaters 430 thus heat the air immediately before it impinges the substrate 12 and coatings 408 thereon. The rod heaters emit radiant energy to heat the air passing thereby, and also serve to heat the sides 412 of the outlet troughs 382, in order to heat the recirculating air passing through outlet troughs 382 and back toward blower 348. In a preferred embodiment of the invention illustrated in FIGS. 13–15, the rod heaters are WATTROD brand rod heaters, available from Watlow of St. Louis, Mo. Rod heaters 340 are controlled by controller 331 which, dependent upon a desired air temperature and feedback from temperature sensors 351 and 409, controls the amount of energy emitted by rod heaters 430.

This simple modification (exchanging trough cover panels 425 for lamp assemblies 402, or vice versa) results in a modular form of dryer system 310 which can be relatively readily adapted for alternative constructions and drying applications. The features of the various embodiments disclosed herein can also be combined to achieve a desired dryer system. Thus, the use of energy emitters within the roll 322 of the embodiment of FIGS. 13–15 is contemplated, as well as using the latter embodiment for duplex drying, such as illustrated in FIG. 6, as well as other compatible feature combinations.

Although the present invention has been described with reference to preferred embodiments, workers skilled in the are will recognize that changes may be made in form and detail without departing from the spirit and scope of the invention.

What is claimed is:

1. A dryer system for drying a coating applied to a substrate, the dryer system comprising:

a substrate support supporting the substrate, wherein the substrate support includes a roll having a length and a peripheral surface for supporting the substrate;

a plurality of energy emitters disposed within the roll along the length of the roll;

means for controlling the plurality of energy emitters to selectively emit energy along the length of the roll;

means for impinging the substrate on the roll with heated air; and means for creating a partial vacuum adjacent the substrate to withdraw the heated air away from the substrate once the heated air has impinged the substrate.

2. The dryer system of claim 1 wherein the means for impinging the substrate has an inlet and wherein the dryer system includes means for circulating the withdrawn heated air to the inlet.

3. The dryer system of claim 1 wherein the means for creating a partial vacuum includes:

a vacuum chamber having at least one inlet adjacent the substrate; and means for withdrawing air from the vacuum chamber.

4. The dryer system of claim 3 wherein the means for withdrawing air from the vacuum chamber comprises a blower.

5. The dryer system of claim 3 wherein the vacuum chamber includes a plurality of inlets arcuately surrounding at least a portion of the roll.

6. The dryer system of claim 1 wherein the means for impinging includes:

a pressure chamber adjacent the substrate, the chamber defining the inlet and including at least one outlet directed at the substrate;

means for heating air within the pressure chamber; and means for pressurizing air within the pressure chamber.

7. The dryer system of claim 6 wherein the means for heating comprises a heater.

8. The dryer system of claim 6 wherein the means for pressurizing comprises a blower.

9. The dryer system of claim 6 wherein the pressure chamber includes a plurality of outlets arcuately surrounding at least a portion of the roll.

10. The dryer system of claim 1 wherein the plurality of energy emitters includes a plurality of band heaters.

11. The dryer system of claim 1 wherein the means for controlling the plurality of energy emitters includes:

a plurality of spaced temperature sensors for sensing temperatures along the length of the roll, wherein the energy emitters are controlled based upon sensed temperatures.

12. The dryer system of claim 1 wherein the means for impinging includes:

a first convection unit arcuately surrounding a first arcuate portion of the roll for impinging the first arcuate portion of the roll with heated air;

a second convection unit arcuately surrounding a second arcuate portion of the roll for impinging the second arcuate portion of the roll with heated air; and means for selectively controlling the first and second convection units.

13. The dryer system of claim 1 including:

an exhaust for removing air from the dryer system to control relative humidity.

14. A method for drying a wet coating applied to a moving web, the method comprising:

supporting the moving web on a rotating roll;

substantially enclosing the moving web and roll;

heating a gas to an elevated temperature;

pressurizing the hot gas and directing the pressurized hot gas towards the moving web on the roll; and creating a partial vacuum adjacent the moving web so as to withdraw the gas once the gas impinges upon the moving web.

15. The method of claim 14 including:

recirculating the withdrawn gas for reheating, repressurization and redirection towards the moving web on the roll.

16. The method of claim 14 including:

emitting energy through the roll for absorption by the moving web.

17. A dryer system for drying a coating applied to a moving web, the dryer system comprising:

a rotating roll for supporting the moving web;

air outlets spaced circumferentially about the roll for impinging the moving web thereon with heated air; and air inlets spaced circumferentially about the roll for creating a partial vacuum adjacent the moving web on the roll once the heated air has impinged the moving web.

18. The dryer system of claim 17, and further comprising:

an air recirculation system connecting the air outlets and air inlets.

19. The dryer system of claim 17, and further comprising:

an energy emitter within the roll for applying energy to the moving web as it traverses the roll.

20. The dryer system of claim 17, and further comprising:

a plurality of energy emitters within the roll for applying energy to the moving web as it traverses the roll.

21. The dryer system of claim 20, wherein the energy emitters are disposed along the length of the roll, and further comprising:

a control apparatus for selectively determining the amount of energy applied by each energy emitter.

22. The dryer system of claim 21 wherein the control apparatus comprises:

a plurality of temperature sensors spaced along the length of the roll, whereby the amount of energy applied by each of the energy emitters is controlled based upon a temperature sensed by a respective one of the temperature sensors.

23. A dryer system for drying a coating applied to a moving web, the dryer system comprising:

a rotating roll for supporting the moving web;

means for impinging the moving web with heated air; and means for creating a partial vacuum adjacent the moving web on the roll to withdraw the heated air away from the moving web once the heated air has impinged the moving web.

* * * * *